US008084965B2

(12) United States Patent
Takayama et al.

(10) Patent No.: US 8,084,965 B2
(45) Date of Patent: Dec. 27, 2011

(54) ALL-ION ACCELERATOR AND CONTROL METHOD OF THE SAME

(75) Inventors: Ken Takayama, Tsuchiura (JP); Yoshito Shimosaki, Sayo-cho (JP); Kota Torikai, Tsukuba (JP); Yoshio Arakida, Tsukuba (JP)

(73) Assignee: Inter-University Research Institute Corporation High Energy Accelerator Research Organization, Tsukuba-shi, Ibaraki (JP)

( * ) Notice: Subject to any disclaimer, the term of this patent is extended or adjusted under 35 U.S.C. 154(b) by 572 days.

(21) Appl. No.: 11/912,986

(22) PCT Filed: Apr. 18, 2006

(86) PCT No.: PCT/JP2006/308502

§ 371 (c)(1), (2), (4) Date: Feb. 18, 2009

(87) PCT Pub. No.: WO2006/118065

PCT Pub. Date: Nov. 9, 2006

(65) Prior Publication Data

US 2009/0195194 A1 Aug. 6, 2009

(30) Foreign Application Priority Data

Apr. 27, 2005 (JP) ..... 2005-129387

(51) Int. Cl.
*H05H 13/04* (2006.01)

(52) U.S. Cl. ..... 315/503; 315/502; 315/504; 313/62

(58) Field of Classification Search ..... 315/500–505; 313/62

See application file for complete search history.

(56) References Cited

U.S. PATENT DOCUMENTS 2,335,014 A * 11/1943 Kerst ..... 315/504
2,599,188 A * 6/1952 Livingston ..... 313/62
3,005,954 A * 10/1961 Heard ..... 315/503

(Continued)

FOREIGN PATENT DOCUMENTS

JP 2000-232000 A 8/2000

OTHER PUBLICATIONS

K. Takayama "Yudo Kasoku Synchrotron no Jissho to sono Oyo"; Nippon Butsuri Gakkaishi, vol. 59, No. 9, pp. 601-610, 2004. Cited in the ISR.

*Primary Examiner* — Jacob Y Choi
*Assistant Examiner* — Ephrem Alemu
(74) *Attorney, Agent, or Firm* — Westerman, Hattori, Daniels & Adrian, LLP

(57) ABSTRACT

An accelerator that can accelerate by itself all ions up to any energy level allowed by the magnetic fields for beam guiding, and provides an all-ion accelerator in which with trigger timing and a charging time of an induced voltage applied to an ion beam injected from a preinjector by induction cells for confinement and acceleration used in an induction synchrotron, digital signal processors for confinement and acceleration and pattern generators for confinement and acceleration generate gate signal patterns for confinement and acceleration on the basis of a passage signal of the ion beam and an induced voltage signal for indicating the value of the induced voltage applied to the ion beam, and intelligent control devices for confinement and acceleration perform feedback control of on/off of the induction cells for confinement and acceleration.

3 Claims, 12 Drawing Sheets

U.S. PATENT DOCUMENTS 3,378,778 A * 4/1968 Hilden et al. ..... 315/503
3,412,337 A * 11/1968 Lothrop ..... 315/503
5,107,222 A * 4/1992 Tsuzuki ..... 315/500
5,783,914 A * 7/1998 Hiramoto et al. ..... 315/504
6,008,499 A * 12/1999 Hiramoto et al. ..... 315/503
6,462,490 B1 * 10/2002 Matsuda et al. ..... 315/503
6,472,834 B2 * 10/2002 Hiramoto et al. ..... 315/501
7,015,661 B2 * 3/2006 Korenev ..... 315/500
7,446,490 B2 * 11/2008 Jongen et al. ..... 315/502

* cited by examiner

ALL-ION ACCELERATOR AND CONTROL METHOD OF THE SAME

TECHNICAL FIELD

The present invention relates to an accelerator for accelerating ions, and more particularly to an accelerator including an induction synchrotron capable of accelerating all ions and a control method thereof.

BACKGROUND ART

An ion refers to an element in the periodic table in a certain charge state. All ions refer to all elements in the periodic table in all charge states that the elements can take in principle. Further, the ions include particles consisting of a large number of molecules such as compounds or protein.

An accelerator is a device for accelerating charged particles such as electrons, protons and ions to a high-energy state on the order of several million electron volts (several MeV) to several trillion electron volts (several TeV), and is broadly classified into radio frequency accelerators and induction accelerators, according to acceleration principles. In addition, an accelerator is classified into linear accelerators and circular accelerators according to their geometrical shapes.

The radio frequency circular accelerator is classified into a cyclotron and an rf synchrotron according to acceleration methods. There are radio frequency accelerators of various size according to use; large-sized accelerators for research in nuclear and particle physics that enable obtainment of extremely high energy, and recent small-sized rf synchrotrons for cancer therapy that provide ion beams of a relatively low energy level.

In the radio frequency accelerator, an rf cavity has been used for accelerating charged particles. The rf cavity produces an rf electric field of several MHz to several tens of MHz in synchronization with traveling of the charged particles by resonant excitation of the rf cavity. Energy from the rf electric field is transferred to the charged particles. A resonance frequency is changed within the range described above, because a revolution frequency at which the charged particle circulates around a design orbit increasing with the energy change of the charged particle.

FIG. 10 shows a conventional rf synchrotron complex 34. An rf synchrotron 35 has been particularly an essential tool for experiments in nuclear and high energy physics. The rf synchrotron 35 is an accelerator for increasing the energy of charged particles to a predetermined level by the principles of resonance acceleration, |strong focusing|[SA], and phase stability, and has a configuration described below.

The conventional rf synchrotron complex 34 includes an injection device 15 that accelerates ions generated by an ion source 16 to several percent or several ten percent of the speed of light with an rf linear accelerator 17*b*, and injects the ions from the rf linear accelerator 17*b* into the subsequent rf synchrotron 35 using an injector 18 constituted by injection devices such as a septum magnet, a kicker magnet, a bump magnet, or the like, the rf synchrotron 35 that accelerates an ion beam 3 to a predetermined energy level, and an extraction device 19 including an extraction system 20 constituted by various magnets that extracts the ion beam 3 accelerated up to the predetermined energy level from the accelerator ring to an ion beam utility line 21 that is a facility 21*a* in which experimental devices 21*b* or the like are placed. The devices are connected by transporting vacuum pipes 16*a*, 17*a* and 20*a*.

The rf synchrotron 35 includes an annular vacuum duct 4 maintained in a high vacuum state, a bending electromagnet 5 that keeps an ion beam 3 along a design orbit, a focusing electromagnet 6 such as a quadrupole electromagnet placed to ensure strong focusing of the ion beam 3 in the vacuum duct 4 both horizontally and vertically, a radio frequency accelerating device 36 constituted by an rf cavity 36*a* that applies an rf acceleration voltage to the ion beam 3 in the vacuum duct 4 and accelerates the ion beam 3, and a control device 36*b* that controls the amplitude and phase of applied radio frequency waves, position monitors 35*a* periodically placed along the entire circumference for measuring the position of the ion beam 3 in the vacuum duct 4, a steering electromagnet 35*b* for modifying the orbit of the ion beam 3 (referred to as Closed Orbit Distortion) using position information of the ion beam 3 obtained by the position monitors 35*a*, a bunch monitor 7 that detects passage of the ion beam 3, or the like.

In the rf synchrotron complex 34 having the above described configuration, the ion beam 3 accelerated up to a certain energy level by the rf linear accelerator 17*b* and injected into the rf synchrotron circulates along the design orbit in the vacuum duct 4 in an advancing axis direction. If the rf voltage is applied to the rf cavity 36*a* at this time, the ion beam 3 forms a group of charged particles (hereinafter referred to as a bunch) around a certain phase of the rf voltage (called as acceleration phase) by a focusing force in the propagating direction of ions.

Then, the frequency of the rf voltage applied to the rf cavity 36*a* is increased in synchronization with an excitation pattern of the bending electromagnet 5 that holds the design orbit of the ion beam 3. Also, the phase of the rf voltage at the bunch center is shifted toward an acceleration phase to increase the momentum of the circulating ion beam 3. The frequency of radio frequency waves must be an integral multiple of the revolution frequency of the ion.

It is known that the relationship of $p=eB\rho$ is satisfied, where e is a charge of each particle in the ion beam 3, p is its momentum, B is a magnetic flux density of the guiding magnet, and $\rho$ is a radius of curvature by bending in a magnetic field. Also, magnetic field strength of the quadrupole electromagnet for focusing the ion beam 3 horizontally and vertically is increased in synchronization with the increase in momentum of the ion beam 3. Thus, the ion beam 3 circulating in the vacuum duct 4 is always positioned on a predetermined fixed orbit. This orbit is referred to as a design orbit.

For synchronization between the rate of increase in momentum of the ion beam 3 and the rate of change in magnetic field strength, a method can be used for measuring the magnetic field strength of the bending electromagnet 5 with a magnetic field measuring search coil, generating a discrete control clock (B clock) every change in the magnetic field strength, and determining the frequency of the radio frequency waves based on the B clock.

Without the complete synchronization between the change in magnetic field strength of the bending electromagnet 5 and the change in radio frequency, a revolution orbit radius of the ion beam 3 would decrease or increase, displacing the ion beam 3 from the design orbit to eventually collide with the vacuum duct 4 or the like and be lost. Generally, the accelerator is not perfect. In most cases, there should be perturbations to deform the circulating orbit from the design orbit, such as errors rf voltage amplitude. Thus, the system is configured so that a displacement of the ion beam 3 from the design orbit is measured by the position monitor 8 for detecting a momentum shift, the phase of the rf voltage required for the ion beam 3 to circulate along the design orbit is calculated, and a feedback is applied so that the rf acceleration voltage is applied to the bunch center at a proper phase.

By the rf acceleration voltage, individual ions receive focusing forces in the propagating direction of ions and are formed into a bunch, and circulate in the rf synchrotron 35 while moving forward and backward in the propagating direction of the ion beam 3. This is referred to as the phase stability of the rf synchrotron 35.

FIG. 11 shows confinement and acceleration principles (phase stability) of the bunch by the radio frequency waves in the conventional rf synchrotron 35.

In the confinement method in the advancing axis direction and the acceleration method of the charged particles in the rf synchrotron 35, it is known that a phase space area in which the bunch 3*a* can be confined is restricted in principle particularly in the advancing axis direction (time axis direction). Specifically, in a time area where the radio frequency waves 37 are at a negative voltage, the bunch 3*a* is reduced in energy, and in a time area with a different polarity of a voltage gradient, the charged particles diffuse in the advancing axis direction and not confined. In other words, only a time period of the acceleration voltage 37*a* shown between the dotted lines can be used for accelerating the ion beam 3.

In the time period of the acceleration voltage 37*a*, the radio frequency waves 37 are controlled to apply an desired constant acceleration voltage 37*b* to a bunch center 3*b*. Thus, the particles positioned in a bunch head 3*c* have higher energy and arrive earlier at the rf cavity 36*a* than the bunch center 3*b* does, and thus receive a lower acceleration voltage 37*c* than the acceleration voltage 37*b* received in the bunch center 3*b* and relatively reduce their velocity. On the other hand, the particles positioned in the bunch tail 3*d* have lower energy and arrive later at the rf cavity 36 than the bunch center 3*b* does, and thus receive larger acceleration voltage 37*d* than the bunch center 3*b* does and relatively increase their velocity. During the acceleration, the particles repeat this process, changing their sitting positions in the bunch head, center, and tail.

A maximum value of an ion beam current that can be accelerated is determined by the size of space-charge forces that is a diffusion force caused by an electric field in the direction perpendicular to the advancing axis of the beam, produced by the ion beam 3 itself. The charged particles in the accelerator receive a force by the focusing magnets and perform motions similar to a harmonic oscillator called betatron oscillation. When the ion beam current exceeds a certain level, the amplitude of the betatron oscillation of the charged particles reaches the size of the vacuum duct 4 and the ion beam is lost. This is referred to as the space-charge limitation.

To be exact, the limitation is made by a maximum value of a local beam current value, that is, a line current density. In the rf synchrotron 35, the bunch center 3*b* usually has maximum line density, inevitably causing an imbalance in current density between the bunch center 3*b* and bunch outer edges such as the bunch head 3*c* and the bunch tail 3*d* without any particular improvement. Thus, the current density in the bunch center 3*b* has to be lower than the limitation. This means that the current density in an rf synchrotron is determined by the charge density in the bunch centre.

Specifically, a resonance frequency $f_{rf}$ of the rf cavity 36*a* is written by $f_{rf}=\frac{1}{4}(L\cdot C)^{1/2}$ using electric parameters (inductance L and capacity C) of the rf cavity 36*a*. The inductance is described by $L=1\cdot(\mu_0\mu^*/2\pi)\log(b/a)$ using the geometrical parameters (length l, inner diameter a, outer diameter b) and material characteristics (relative permeability $\mu^*$) of a magnetic material loaded in the rf cavity 36*a*.

A revolution frequency $f_0$ of the particle and the resonance frequency $f_{rf}$ of the rf cavity 36*a* have to always maintain the relationship of $f_{rf}=hf_0$ (h: integer) so as to maintain the synchronization with revolution of particles. This is achieved by exciting the magnetic material with an additional current referred to as a bias current and changing an operation point on a B-H curve, and controlling the relative permeability $\mu^*$.

Ferrite is generally used as a magnetic material of the rf cavity 36*a*. Its maximum inductance is obtained when the bias current is around 0 A, and a resonance frequency determined at the operation point is minimum.

In the rf synchrotron 35 designed and constructed exclusively for protons or particular ions, species and charge state can be selected only within a range allowed by a finite variable width of frequency of the rf cavity 36*a* itself and a radio frequency power amplifier, such as a triode or tetrode, drives the rf cavity.

Thus, in the conventional rf synchrotron 35, once the ion species to be accelerated, an acceleration energy level, and an accelerator peripheral length are determined, a frequency bandwidth of the radio frequency waves 37 is uniquely determined.

FIG. 12 shows the revolution frequency in the rf synchrotron 35 from injection and to end of acceleration for acceleration of various ions with the KEK 500 MeV booster proton synchrotron (hereinafter referred to as KEK 500 MeVPS) by High energy accelerator research organization (hereinafter referred to as KEK). The axis of ordinate represents the revolution frequency (MHz), and the axis of abscissa represents the acceleration time (msec). The KEK 500 MeVPS is an rf synchrotron 35 for protons having a peripheral length of about 35 m.

H (1, 1), U (238, 39) and U (283, 5) represent a proton, a uranium ion (+39), and a uranium ion (+5) respectively, and changes in acceleration frequency thereof are shown in the figure.

The results in FIG. 12 show that, in the rf synchrotron 35 designed for accelerating protons or light ions, heavy ions such as uranium ions cannot be accelerated from a low energy level of an extremely low revolution frequency up to a high energy level. The revolution frequency of ions heavier than protons and lighter than uranium ions (+5) places within a range shown by the double-headed vertical broken arrow.

On the other hand, cyclotrons have been conventionally used as accelerators for accelerating various ions. Like the rf synchrotron 35, the cyclotron also uses an rf cavity 36*a* as an accelerating device of an ion beam 3. Thus, from the principle limitation in use of radio frequency waves 37, the cyclotron is used only for ions with the same Z/A, where A is the mass number and Z is the charge state of an ion that can be accelerated.

Further, the revolution orbit of the ion beam 3 is held in a uniform magnetic field from a central portion with the ion source 16 to an outermost portion that an extraction orbit is located, and a necessary magnetic field is produced by a bipolar magnet with iron as a magnetic material. However, such a magnet is limited in physical size.

Thus, the maximum value of acceleration energy in cyclotrons constructed heretofore is 520 MeV per nucleon. The weight of iron reaches 4000 tons.

In recent years, an induction synchrotron as a circular accelerator for protons different from the radio frequency accelerator has been proposed. The induction synchrotron for protons is an accelerator that can eliminate the disadvantages of the rf synchrotron 35. Specifically, the induction synchrotron for protons is an accelerator that can contain a large number of protons in an advancing axis direction while maintaining a constant line density at a limit current value or less.

A first feature of the induction synchrotron for protons is that a proton beam can be confined in the advancing axis direction by a pair of positive and negative induced voltages in pulse generated by an induction cell to form a long proton bunch (super-bunch) in the order of μsec.

A second feature is that the confined super-bunch can be accelerated by an induced voltage of a long pulse length generated by a different induction cell.

Specifically, the conventional rf synchrotron 35 is of a functionally combined type that performs confinement and acceleration of protons with common radio frequency waves 37 in an advancing axis direction, while the induction synchrotron is of a functionally separated type that independently performs confinement and acceleration.

An induction accelerating device allows the separation of the confinement and acceleration of protons. The induction accelerating device includes an induction cell for confinement of protons and an induction cell for acceleration of protons as one-to-one transformers having magnetic material cores, and switching power supplies for driving the induction cells, or the like.

A pulse voltage is generated in the induction cell in synchronization with a revolution frequency of a proton beam. For example, in an accelerator having a circumference on the order of 300 m, a pulse voltage has to be generated at a repetition of 1 MHz CW.

As a direct application of the induction synchrotron for protons, a proton driver for exploring next-generation neutrino oscillations and proton-proton colliders employing super-bunches have been proposed. With these accelerators, it is expected that a higher proton beam intensity four times the proton beam intensity of a proton accelerator realized by the conventional rf synchrotron 35 is achieved.

A collider as an application of the induction synchrotron is referred to as a super-bunch hadron collider. The super-bunch hadron collider that makes the most use of the specific features of an induction synchrotron is expected to realize a luminosity an order of magnitude larger than a collider of the same size based on a synchrotron using the conventional radio frequency waves 37. This is equivalent to the luminosity simultaneously provided by 10 colliders based on the rf synchrotron. It is noted that the construction cost of each collider can reach 300 billion yen.

Now, the acceleration principle in the induction synchrotron will be described. Induced voltages having different polarities are generated by the induction cells. A velocity of proton having momentum larger than momentum of an ideal particle positioned in the bunch center 3*b* is higher than that of the ideal particle, and thus the proton advances and reaches the bunch head 3*c*. When the proton reaches the bunch head 3*c*, the proton is reduced in velocity by a negative induced voltage, reduced in momentum, and becomes lower in velocity than the ideal particle locating at the bunch center, and starts moving backward of the bunch 3*a*. When the proton reaches the bunch tail 3*d*, the proton starts receiving a positive induced voltage, and is accelerated. Thus, the momentum of the proton exceeds the momentum of the ideal particle. During acceleration, all protons belonging to the proton bunch repeat the above described process.

This is essentially the same as the well-known phase stability (FIG. 11) of the rf synchrotron 35. By this property, the protons are confined in the form of the bunch 3*a* in the advancing axis direction.

However, the proton cannot be accelerated by induced voltages having the different polarities. Thus, the proton has to be accelerated by another induction cells that can apply a uniform positive induced voltage. It is known and demonstrated that the functional separation of confinement and acceleration significantly increases flexibility in beam handling in the propagating direction of ions.

An induction accelerating device that generates an induced voltage of 2 kV at a repetition rate of 1 MHz CW has been completed and introduced in the KEK 12 GeV proton rf synchrotron (hereinafter referred to as 12 GeVPS). The 12 GeVPS is an rf synchrotron 35 for protons having a circumference of about 340 m. In the recent experiment on induction acceleration where a proton bunch was confined by the existing rf voltage and accelerated with the induction voltage, the 12 GeVPS has succeeded to demonstrate the induction acceleration of a proton beam from 500 MeV up to 8 GeV.

The above demonstrated technique is described in "The Physical Society of Japan, Vol. 59, No. 9 (2004), p601-610, Phys. Rev. Lett. Vol. 94. No. 144801-4 (2005)".

However, it has been heretofore considered to be impossible to accelerate various species of ion in their allowed charge states in a single accelerator to obtain high energy.

This is because in the conventional rf synchrotron 35, the rf cavity 36*a* as a resonator used for acceleration has a high quality factor, and radio frequency waves 37 can be excited only in a finite band width. Thus, when the circumference of the rf synchrotron 35, the field strength of the bending electromagnet 5 used, and the bandwidth of the radio frequency waves 37 used are determined, the mass number A and the charge state Z of ions that can be accelerated are substantially and uniquely determined and only the limited ions can be accelerated in a low energy area where the velocity significantly changes.

On the other hand, in a cyclotron, only ions having a constant ratio between the mass number and the charge state can be accelerated correspondingly to the bandwidth of the radio frequency waves 37. Also, in an electrostatic accelerator such as a Van de Graaff accelerator that can accelerate any ions, the limit of acceleration energy is 20 MeV from the capability of voltage-resistance of the device in vacuum or pressured gas.

The linear induction accelerator can provide a energy of several hundred MeV or more, but the cost for obtaining the energy and the physical size of the linear induction accelerator become enormous. Parameters of the linear induction accelerator presently obtained are substantially a hundred million yen/1 MeV and 1 m/1 MeV. Thus, obtaining an ion beam of 1 GeV requires a cost of 100 billion yen, and the entire length of the accelerator of 1 km.

Further, in the induction synchrotron for protons, such as the KEK 12 GeVPS that has been demonstrated as an induction synchrotron, its injection energy is already sufficiently high, and acceleration of protons substantially having the speed of light only has been considered. Specifically, the proton beam is already accelerated substantially up to the speed of light in the upstream accelerator. Thus, when the protons are accelerated by the induction synchrotron, it is only necessary to generate an induced pulse voltage of the induction cell at almost constant intervals. Thus, trigger timing of the induced voltage applied to the proton beam needs not to be changed with acceleration.

However, when all ions are accelerated in a single induction synchrotron, the trigger timing of the induced voltage has to be changed depending on the revolution of individual ion species. This is because the revolution frequency significantly differs among ion species as shown in FIG. 12.

Thus, the present invention has an object to provide an accelerator that can accelerate by itself all ions up to any energy level allowed by the field strength of electromagnets used for beam guiding (hereinafter referred to as any energy level).

DISCLOSURE OF THE INVENTION

In order to achieve the above described object, the present invention provides an accelerator for all ions, including: an induction synchrotron including an annular vacuum duct having a design orbit of an ion beam therein, a bending electromagnet that is provided on a curved portion of the design orbit and holds a circular orbit of the ion beam, a focusing electromagnet that is provided on a linear portion of the design orbit and prevents diffusion of the ion beam in the direction perpendicular to the propagating direction of ions, a bunch monitor that is provided in the vacuum duct and detects passage of the ion beam, position monitors that are provided in the vacuum duct and detects the center of gravity position of the ion beam, an induction accelerating device for confinement including an induction cell for confinement that is connected to the vacuum duct and applies an induced voltage for confinement of the ion beam in an propagating direction of ions and an intelligent control device for confinement that controls driving of the induction cell for confinement, and an induction accelerating device for acceleration including an induction cell for acceleration that is connected to the vacuum duct and applies an induced voltage for acceleration of the ion beam and an intelligent control device for acceleration that controls driving of the induction cell for acceleration; an injection device including an injector that injects the ion beam into the induction synchrotron, with ions generated by an ion source being accelerated up to a certain energy level by a preinjector; and an extraction device that extracts the ion beam from the induction synchrotron to an ion beam utility line, characterized in that the intelligent control device for confinement performs feedback control of trigger timing and a charging time-period of an induced voltage applied to the induction cell for confinement with a digital signal processor for confinement that receives a passage signal from the bunch monitor and an induced voltage signal from a voltage monitor for indicating the value of the induced voltage applied to the ion beam, and calculates a gate master signal for confinement that becomes the basis of a gate signal pattern for confinement of a pattern generator for confinement, the pattern generator for confinement generating a gate signal pattern for confinement that controls on/off of a switching power supply for confinement to drive the induction cell for confinement, the intelligent control device for acceleration performs feedback control of trigger timing and a charging time-period of an induced voltage applied to the induction cell for acceleration with a digital signal processor for acceleration that receives a passage signal from the bunch monitor, position signals from the position monitors, and an induced voltage signal from the voltage monitor for indicating the value of the induced voltage applied to the ion beam, and calculates a gate master signal for acceleration that becomes the basis of a gate signal pattern for acceleration of a pattern generator for acceleration, the pattern generator for acceleration generating a gate signal pattern for acceleration that controls on/off of a switching power supply for acceleration to drive the induction cell for acceleration, and all ions are accelerated and controlled to any energy level allowed by the magnetic fields of electromagnets used for beam guiding.

BEST MODE FOR CARRYING OUT THE INVENTION

Figure 1:
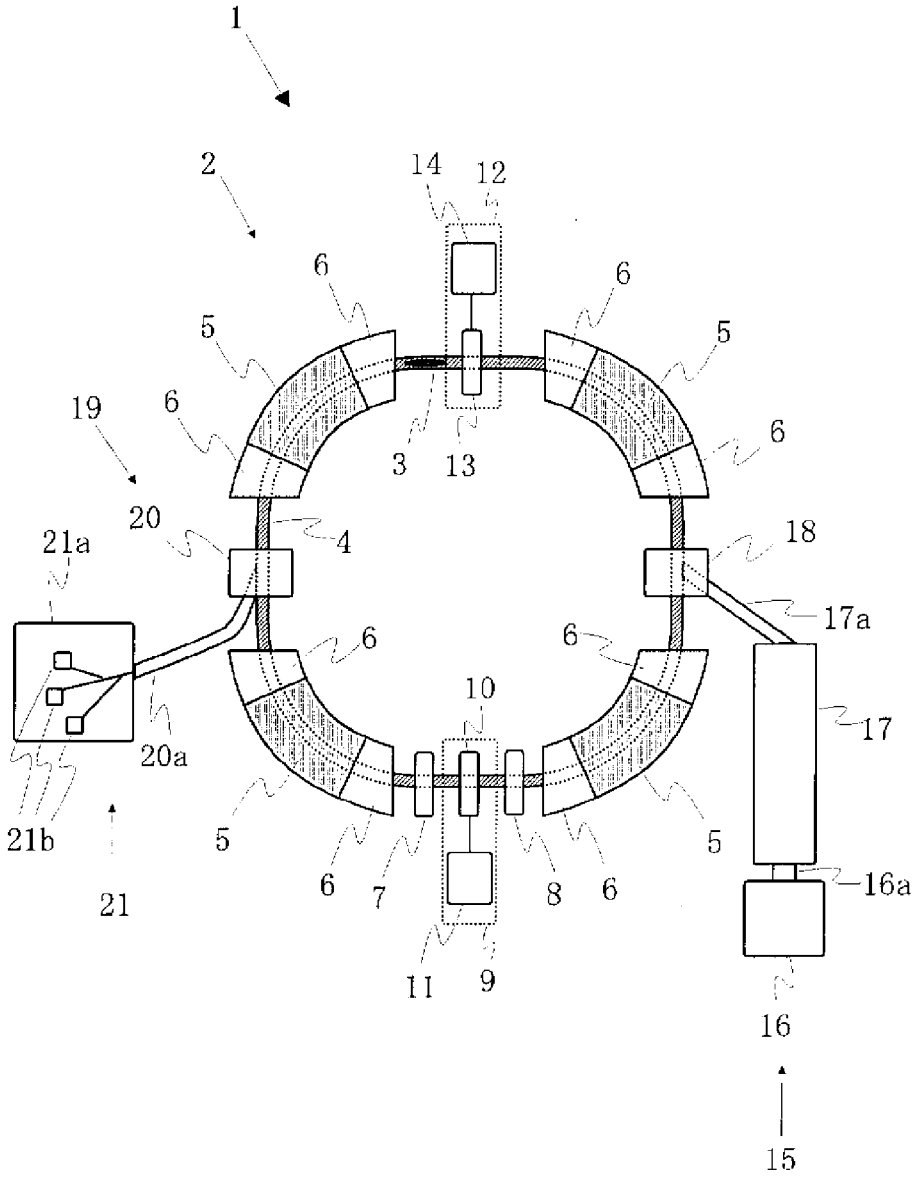
FIG. 1 is a whole block diagram of an all-ion accelerator of the present invention.

A configuration of a focusing electromagnet 6 of an induction synchrotron 2 that constitutes an all-ion accelerator 1 of the present invention is a strong focusing configuration as in a conventional rf synchrotron 35. A radio frequency accelerating device 36 is replaced by an induction accelerating device for confinement 9 and an induction accelerating device for acceleration 12. An induction cell for confinement 10 and an induction cell for acceleration 13 that constitute the induction accelerating device for confinement 9 and the induction accelerating device for acceleration 12 are driven by switching power supplies capable of operating at a high repetition rate for confinement and acceleration 9*b* and 12*b* that generate pulse voltages 10*f*. On/off operations of the switching power supplies for confinement and acceleration 9*b* and 12*b* are performed by controlling gate signal patterns for confinement and acceleration 11*a* and 14*a* responsible for gate driving of switching elements such as MOSFETs used in the switching power supplies for confinement and acceleration 9*b* and 12*b*.

The gate signal patterns for confinement and acceleration 11*a* and 14*a* are generated by pattern generators for confinement and acceleration 11*b* and 14*b*. The pattern generators for confinement and acceleration 11*b* and 14*b* start their operation by gate master signals for confinement and acceleration 11*c* and 14*c*.

The gate master signal for confinement 11*c* is generated in real time by a previously programmed processing method by a digital signal processor for confinement 11*d* on the basis of a passage signal 7*a* of the ion beam 3 detected by a bunch monitor 7 and an induced voltage signal 9*e* for indicating the value of an induced voltage applied to the ion beam 3 by the induction cell for confinement 10.

The gate master signal for acceleration 14*c* is generated in a real time by a previously programmed processing method by a digital signal processor for acceleration 14*d* on the basis of a passage signal 7*b* of the ion beam 3 detected by the bunch monitor 7, a position signal 8*a* of the ion beam 3 detected by a position monitor 8, and an induced voltage signal 12*e* for indicating the value of an induced voltage applied to the ion beam 3 by the induction cell for acceleration 13.

Ions generated by an ion source 16 are accelerated to a certain velocity by a preinjector 17, and the ion beam 3 of the ions is injected into the induction synchrotron 2 continuously for a certain time-period. Then, the induction cell for confinement 10 is turned on to generate negative and positive barrier voltages 26 and 27 (hereinafter simply referred to as barrier voltages). Then, a time duration between barrier voltage pulses 30 is gradually reduced, and the ion beam 3 distributed over the entire region of a design orbit 4*a* is formed into a bunch 3*a* on the order of the length of a charging time-period 28*a* of an acceleration voltage 28 generated by the induction cell for acceleration 13. Then, a bending electromagnet 5 and the focusing electromagnet 6 of the induction synchrotron 2 are excited from their injection field levels.

The pulse voltages 10*f* of the negative and positive barrier voltages 26 and 27 of the induction cell for confinement 10 are controlled on the basis of the passage signal 7*a* that is the passage information of the ion beam 3 obtained from the bunch monitor 7 and the induced voltage signal 9*e* for indicating the value of the induced voltage applied to the ion beam 3 to generate the gate signal pattern for confinement 11*a* in synchronization with excitation of magnetic fields.

On the basis of the passage signal 7*b* obtained by the bunch monitor 7, the position signal 8*a* obtained by the position monitor 8, and the induced voltage signal 12*e* for indicating the value of the induced voltage applied to the ion beam 3, the pulse voltages 10*t* of the acceleration voltage 28 (hereinafter simply referred to as an induced voltage for acceleration) and a reset voltage 29 of the induction cell for acceleration 13 are controlled to generate a gate signal pattern for acceleration 14*a* in synchronization with excitation of magnetic fields.

The generation of the barrier voltage of a certain constant level of amplitude and the induced voltage of a certain constant level of amplitude for acceleration is controlled in time for the ion beam 3 to follow the excitation of the magnetic fields. Thus, the ion beam 3 is inevitably formed into the bunch 3*a* and accelerated. The series of control devices for confinement and acceleration of the ion beam 3 are intelligent control devices for confinement and acceleration 11 and 14.

Thus, all ions can be accelerated to an allowed energy level simply by changing program settings of the digital signal processors for confinement and acceleration 11*d* and 14*d* in the feedback control by the intelligent control devices for confinement and acceleration 11 and 14, depending on ion species and target energy.

Finally, after the end of the acceleration (a maximum magnetic field excitation state), the ion beam 3 accelerated up to the predetermined energy level is extracted to an ion beam utility line 21. An extraction method includes a method of extracting the ion beam 3 in one turn by a rapid extraction system 20 such as an kicker magnet while maintaining a structure of the bunch 3*a*, and a method of gradually increasing the time duration between barrier voltage pulses 30 up to a time corresponding to a revolution time period, then once turning off the gate driving of the switching power supplies for confinement 9*b* and 12*b* for driving the induction cell for confinement 10 to break the structure of the bunch 3*a* into the ion beam 3 in the form of a DC beam, and then continuously extracting the ion beam 3 little by little in a number of turns by the extraction system 20 using betatron resonance. The extraction method can be selected according to the purpose of use of the ion beam 3.

Now, the all-ion accelerator 1 of the present invention will be described in detail with reference to the accompanying drawings. FIG. 1 is a whole block diagram of the all-ion accelerator of the present invention. The all-ion accelerator 1 of the present invention may use devices used in a conventional rf synchrotron complex 34 other than the induction accelerating device for confinement 9, the induction accelerating device for acceleration 12 for controlling acceleration of the ion beam 3 and an rf linear accelerator 17*b*.

The all-ion accelerator 1 includes an injection device 15, the induction synchrotron 2, and an extraction device 19. The injection device 15 includes the ion source 16, the preinjector 17, an injector 18, and transport pipes 16*a* and 17*a* that connect the devices which are placed upstream of the induction synchrotron 2.

As the ion source 16, an ECR ion source using an electronic cyclotron resonance heating mechanism, a laser driven ion source, or the like is used. The ion beam may be directly injected from the ion source 16 into the induction synchrotron.

As the preinjector 17, a variable-voltage electrostatic accelerator or a linear induction accelerator is generally used. When the ion species to be used are determined, a small-sized cyclotron may be used.

As the injector 18, a device used in the complex of rf synchrotron 34 is used. No particular device and method is required for the all-ion accelerator 1 of the present invention.

In the injection device 15 having the above described configuration, the ion beam 3 generated by the ion source 16 is accelerated by the preinjector 17 to a certain energy level and injected into the induction synchrotron 2 by the injector 18.

The induction synchrotron 2 includes an annular vacuum duct 4 having the design orbit 4*a* of the ion beam 3 therein, the bending electromagnet 5 that is provided on a curved portion of the design orbit 4*a* and holds a circular orbit of the ion beam 3, the focusing electromagnet 6 that is provided on a linear portion of the design orbit 4*a* and prevents diffusion of the ion beam 3, the bunch monitor 7 that is provided in the vacuum duct 4 and detects passage of the ion beam 3, the position monitor 8 that is provided in the vacuum duct 4 and detects the center of gravity position of the ion beam 3, the induction accelerating device for confinement 9 including the induction cell for confinement 10 that is connected to the vacuum duct 4 and generates an induced voltage for confinement of the ion beam 3 in an propagating direction of ions and the intelligent control device for confinement 11 that controls driving of the induction cell for confinement 10, and the induction accelerating device for acceleration 12 including the induction cell for acceleration 13 that is connected to the vacuum duct 4 and generates an induced voltage for acceleration of the ion beam 3 and the intelligent control device for acceleration 14 that controls driving of the induction cell for acceleration 13.

The devices for confinement have the function of reducing the length of the ion beam 3 injected from the injection device 15 into the induction synchrotron 2 to be formed into the bunch 3*a* having a certain length so that the ion beam can be accelerated by another induction cell with a predetermined induced voltage or changing the length of the ion beam 3 in various ways, and the function of providing phase stability to the bunch 3*a* of the ion beam 3 during acceleration.

The devices for acceleration have the function of providing an induced voltage for acceleration to the entire bunch 3*a* after the formation of the bunch 3*a* of the ion beam 3.

The induction accelerating device for confinement 9 and the induction accelerating device for acceleration 12 are the same in physics and electronics sense, but different in function to the ion beam 3. Hereinafter, the induction accelerating device means both the induction accelerating device for confinement 9 and the induction accelerating device for acceleration 12. Similarly, the induction cell means both the induction cell for confinement 10 and the induction cell for acceleration 13. Further, the electromagnet means both the bending electromagnet 5 and the focusing electromagnet 6.

The extraction device 19 includes a beam transport pipe 20*a* that connects to a facility 21*a* in which experimental devices 21*b* or the like using the ion beam 3 accelerated up to the predetermined energy level by the induction synchrotron 2 are placed, and the extraction system 20 that extracts the ion beam 3 to the ion beam utility line 21. The experimental devices 21*b* include medical facilities used for therapy.

As the extraction system 20, a kicker magnet for rapid extraction, or a device for slow extraction using betatron resonance or the like may be used, and the extraction system can be selected depending on the ways of use of the ion beam 3.

With the above described configuration, the all-ion accelerator 1 of the present invention by itself can accelerate all ions up to any energy level.

Figure 2:
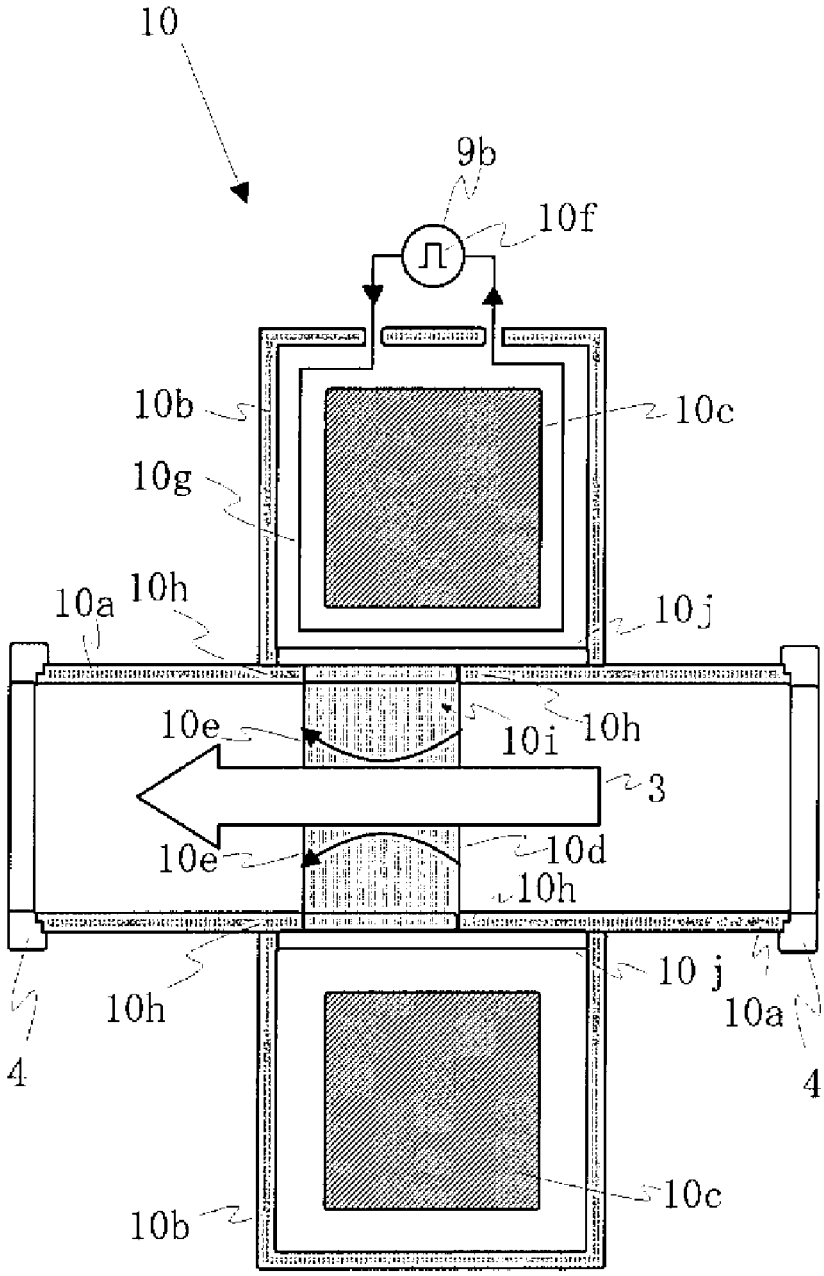
FIG. 2 is a sectional view of an induction cell.

FIG. 2 is a sectional schematic diagram of the induction cell for confinement that constitutes the all-ion accelerator.

The induction cells for confinement and acceleration 10 and 13 used in the present invention have the same structure in principle as an induction cell for a linear induction accelerator constructed heretofore. The induction cell for confinement 10 will be described herein. The induction cell for confinement 10 has a double structure of an inner cylinder 10*a* and an outer cylinder 10*b*, and a magnetic material 10*c* is inserted into the outer cylinder 10*b* to produce an inductance. Part of the inner cylinder 10*a* connected to the vacuum duct 4 through which the ion beam 3 passes is made of an insulator 10*d* such as ceramic. Since the induction cell generates heat in use, any coolant, such as cooling oil or the like is circulated in the outer cylinder 10*b*, which requires an insulator seal 10*j*.

When the pulse voltage 10*f* is applied from the switching power supply 9*c* to a primary coil surrounding the magnetic material 10*c*, a primary current 10*g* (core current) flows through the circuit to excite the magnetic material 10*c*, thereby increasing the density of a magnetic flux passing through the magnetic material 10*c* of toroidal shape in time. During this time-period, the electric field 10*e* is induced according to Faraday's induction law on a secondary side including opposite ends 10*h* of the inner cylinder 10*a* of a conductor with the insulator 10*d* therebetween. The electric field 10*e* becomes an acceleration electric field. A portion where the acceleration electric field is produced is an acceleration gap 10*i*. Thus, the induction cell for confinement 10 is equivalent to a one-to-one transformer.

The switching power supply for confinement 9*b* that generates the pulse voltage 10*f* is connected to the primary coil of the induction cell for confinement 10, and the switching power supply for confinement 9*b* is externally turned on/off to freely control the production of the acceleration electric field. This means that the acceleration of the ion beam 3 can be controlled in a digital manner.

When the bunch head 3*c* (where ions exist having somewhat higher energy than the ions in the bunch center 3*b*) of the ion beam 3 enters the acceleration gap 10*i*, an induced voltage (hereinafter referred to as a negative barrier voltage) that has a length corresponding to a time width of the head and provides the electric field 10*e* in an opposite direction from the propagating direction of ions is generated in the induction cell for confinement 10. The energy of the ions is reduced by the negative barrier voltage. In a time period when the bunch center 3*b* of the ion beam 3 passes, no induced voltage is generated.

In a time period when the bunch tail 3*d* (where ions exist having somewhat lower energy than the ions in the bunch center 3*b*) passes, an induced voltage (hereinafter referred to as a positive barrier voltage) that provides the electric field 10*e* in the same direction as the propagating direction of ions is generated. The energy of ions is increased by the induced voltages of different sign.

When the ion beam 3 repeatedly receives the induced voltages of different sign, the energy of the ions first having higher energy than the ions in the bunch center 3*b* becomes lower than the energy of the ions in the bunch center 3*b*; the arrival timing at the induction cell for acceleration is gradually and relatively delayed. On the other hand, the bunch tail 3*d* receives the induced voltage that provides the electric field 10*e* in the same direction as the propagating direction of the ion beam 3 as described above, and after a while, the particles once located in the bunch tail overtake the bunch center 3*b* and become to arrive at the induction cell for confinement 10 relatively earlier to locate in the bunch head. The ion beam 3 is accelerated while repeating the above series of processes. This is referred to as confinement of the ion beam 3 in the propagating direction of ions.

Figure 11:
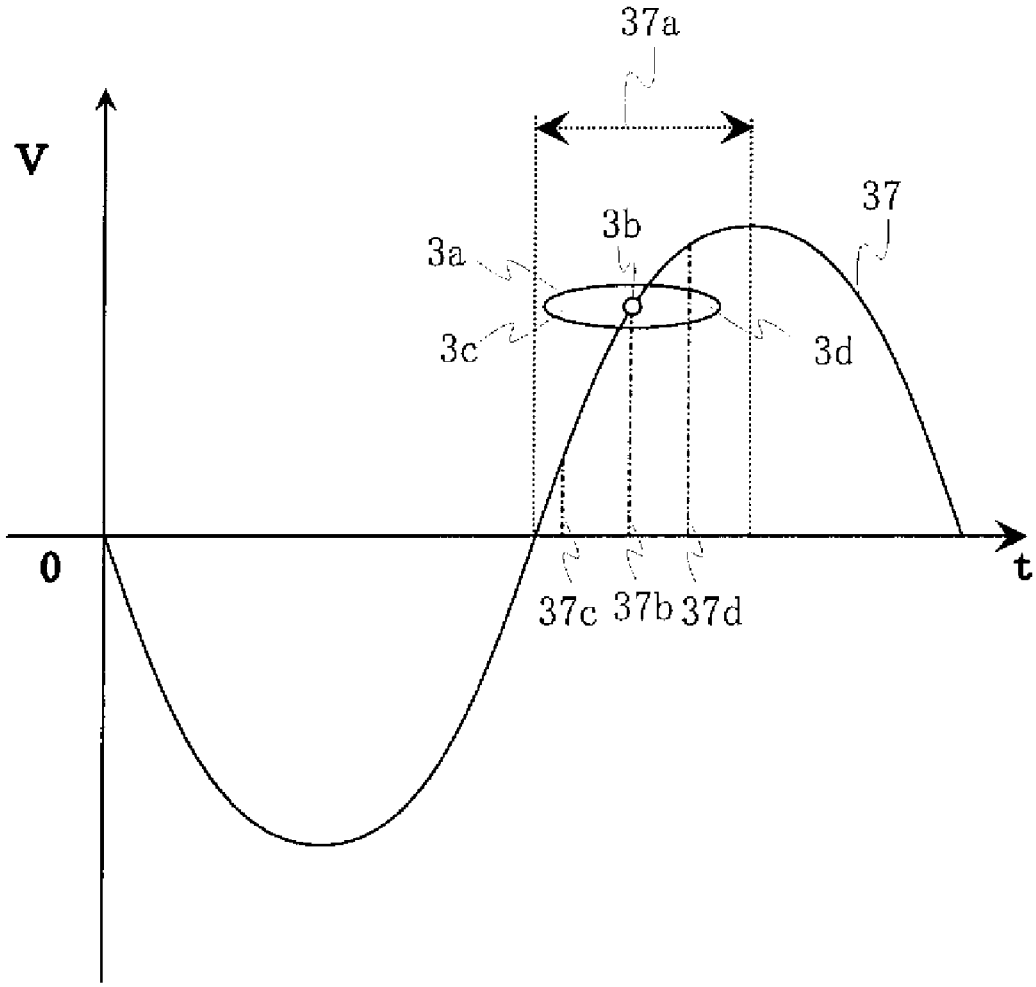
FIG. 11 shows the principle of phase stability in the rf synchrotron.
Figure 12:
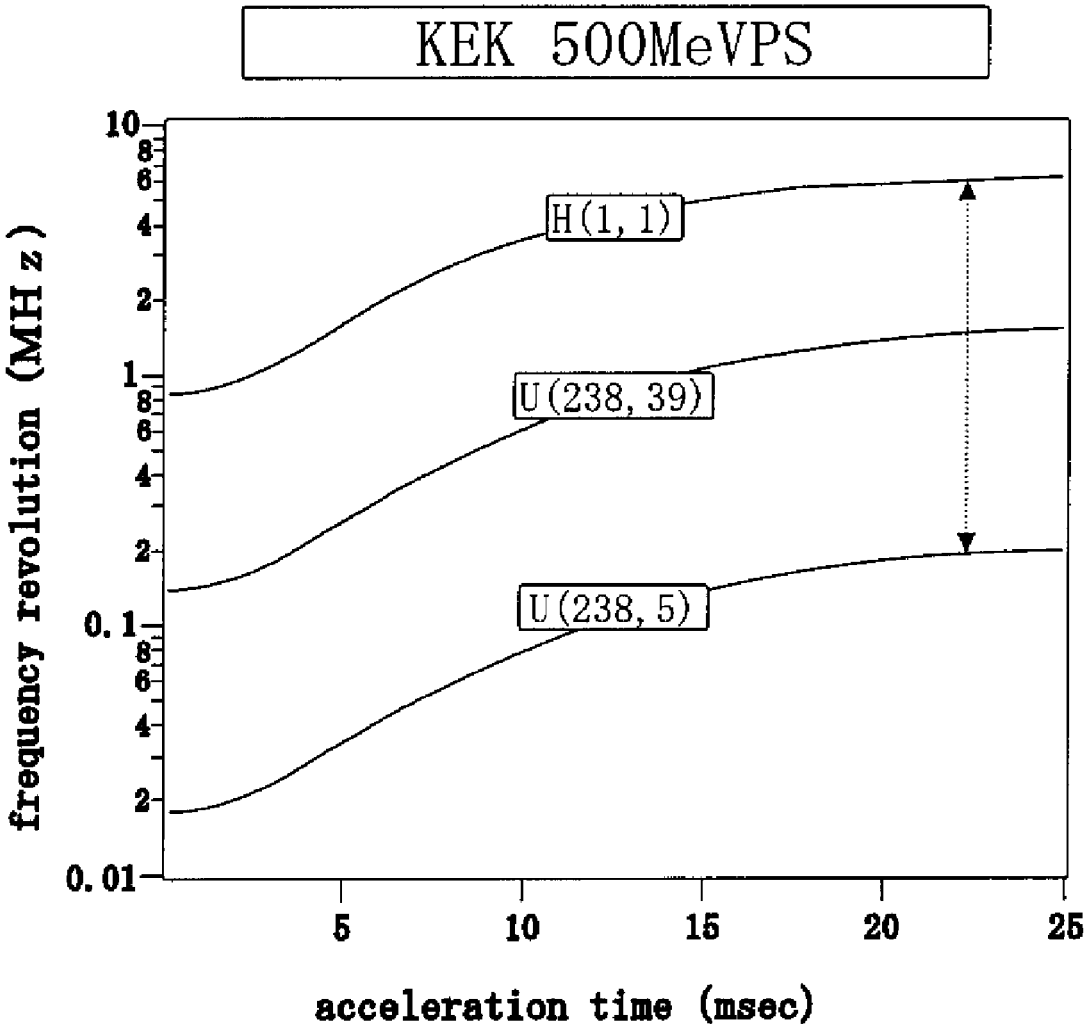
FIG. 12 shows estimated changes in revolution frequency from injection and end of acceleration for various ions in acceleration by the existing KEK 500 MeVPS.

This provides the same advantage as the phase stability (FIG. 11) in the conventional rf synchrotron 35. The function of the induction cell for confinement 10 is equivalent to the function of confinement of the conventional rf cavity 36*a* In the induction synchrotron, however, the induced voltage is discontinuously applied to the ion beam 3 as the pulse voltage 10*f*, and thus the induction cell has a digital operation property, in the contrast to a fact that the rf cavity 36*a* in the conventional rf synchrotron is always excited with the radio frequency waves 37, whatever there exists the ion beam 3 in it or not.

On the other hand, in the induction cell for acceleration 13, an induced voltage (hereinafter referred to as an acceleration voltage) is generated so as to produce an acceleration field in the same direction as the propagating direction of ions during the passage of the ion beam 3 through the acceleration gap 10*i*. In order to prevent magnetic saturation of the magnetic material 10*c*, an induced voltage (hereinafter referred to as a reset voltage) in an opposite sign from the induced voltage has to be generated in any time between the passage of the ion beam 3 and the next passing of the ion beam 3. It is noted that for the induction cell for confinement 10, the induced voltage generated by the reset is also effectively used for confinement in the propagating direction of ions.

Though one induction cell has been herein described, a number of induction cells is selected from a requirement on pulse-length of the induced voltage for the accelerated ion beam 3 and a required acceleration voltage per revolution or the like. A design of an induction cell having a low voltage droop is desired.

Figure 3:
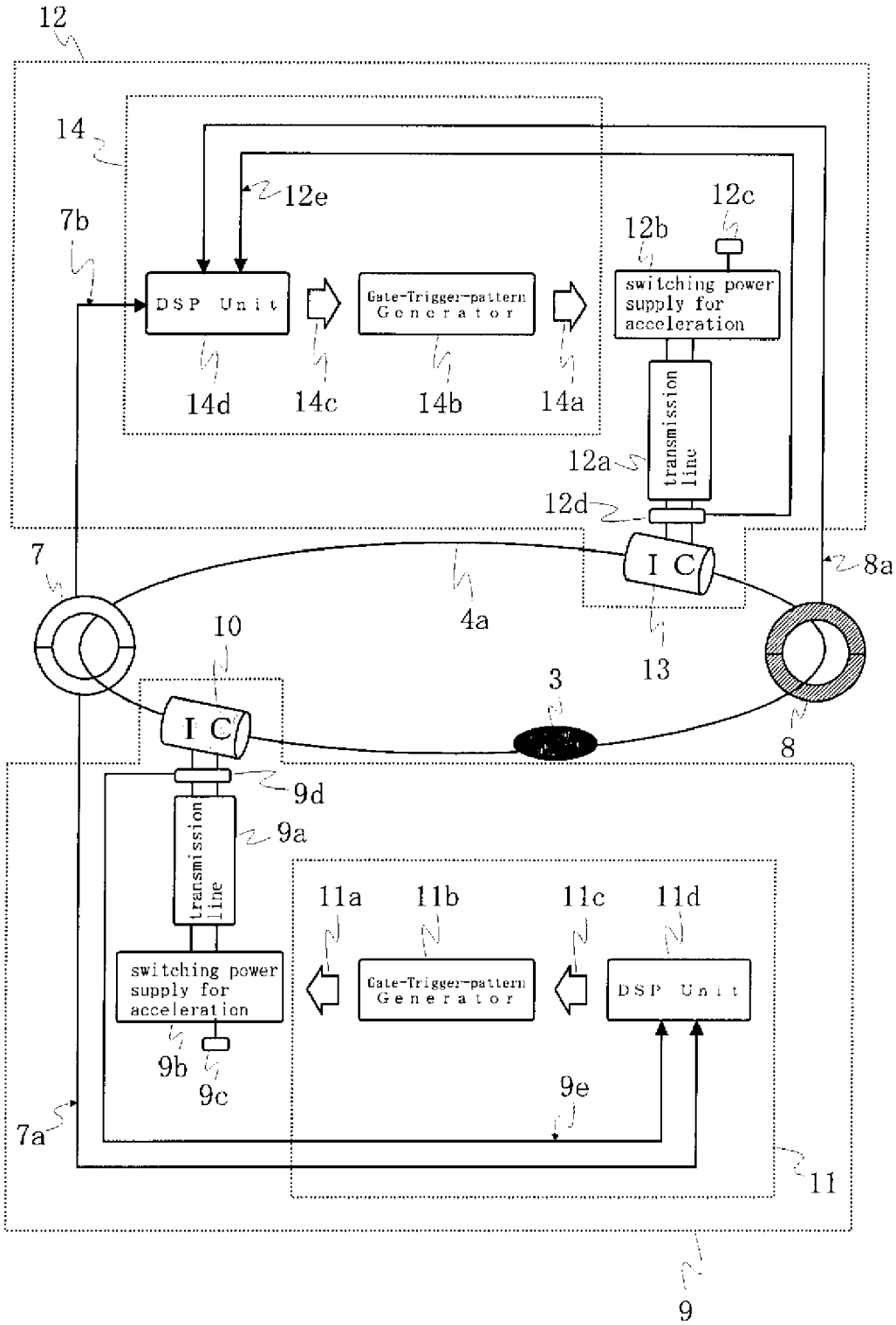
FIG. 3 is a schematic diagram of the induction cell and intelligent control devices for confinement and acceleration.

FIG. 3 shows a configuration of the induction accelerating device and an acceleration control method of the ion beam.

The induction accelerating device for confinement 9 includes the induction cell for confinement 10 that generates the barrier voltage that is a pair of induced voltages with different polarity for confinement of the ion beam 3 in the propagating direction of ions, the switching power supply capable of operating at high rep-rate for confinement 9*b* that supplies the pulse voltage 10*f* to the induction cell for confinement 10 via a transmission line 9*a*, the DC power supply 9*c* that supplies electric power to the switching power supply for confinement 9*b*, the intelligent control device for confinement 11 that performs feedback control of on/off operations of the switching power supply for confinement 9*b*, and a voltage monitor 9*d* for indicating the value of the induced voltage applied from the induction cell for confinement 10.

The transmission line 9*a* is used when a switching used in the switching power supply for confinement 9*b* is a semiconductor or the like and cannot survive a high radiation environment. The transmission line 9*a* is unnecessary for a switching element without the risk of radiation damage or the case where a low radiation environment can be maintained, and the switching power supply for confinement 9*b* and the induction cell for confinement 10 can be directly connected.

The intelligent control device for confinement 11 includes the pattern generator for confinement 11*b* that generates the gate signal pattern for confinement 11*a* for controlling on/off operations of the switching power supply for confinement 9*b*, and the digital signal processor for confinement 11*d* that calculates the gate master signal for confinement 11*c* that is essential information of the generation of the gate signal pattern for confinement 11*a* by the pattern generator for confinement 11*b*.

The gate master signal for confinement 11*c* is calculated by the digital signal processor for confinement 11*d* according to a previously programmed processing method on the basis of the passage signal 7*a* of the ion beam 3 measured by the bunch monitor 7 that detects the passage of the ion beam 3 placed on the design orbit 4*a*, and the induced voltage signal 9*e* measured by the voltage monitor 9*d* for indicating the value of the induced voltage applied to the ion beam 3, and generated in real time.

Specifically, in the digital signal processor for confinement 11*d*, the trigger timing of the applied barrier voltage is calculated from the passage signal 7*a*, and the length of the time-period of the barrier voltage is calculated from the passage signal 7*a* and the induced voltage signal 9*e*, which are converted into digital signals and sent to the pattern generator for confinement 11*b*.

The gate signal pattern for confinement 11*a* includes three patterns of the negative barrier voltage 26 applied to the ion beam 3, the positive barrier voltage 27, and the voltage off. The value of the negative barrier voltage and the value of the positive barrier voltage are different depending on the properties and kinds of the ion beam 3, but may be constant during acceleration and thus may be previously programmed in the digital signal processor for confinement 11*d*. The value of the induced voltage is uniquely determined by an output voltage of the DC power supply 9*c* and a bank capacitor 23 used.

The induction accelerating device for acceleration 12 includes the induction cell for acceleration 13 that generates the induced voltage for acceleration constituted by the acceleration voltage for accelerating the ion beam 3 in the propagating direction of ions and the reset voltage for preventing magnetic saturation of the magnetic material 10*c*, the switching power supply for acceleration 12*b* capable of operating at a high repetition rate that supplies the pulse voltage 10*f* to the induction cell for acceleration 13 via a transmission line 12*a*, a DC power supply 12*c* that supplies electric power to the switching power supply for acceleration 12*b*, the intelligent control device for acceleration 14 that performs feedback control of on/off operations of the switching power supply for acceleration 12*b*, and the voltage monitor 12*d* for indicating the value of the induced voltage applied from the induction cell for acceleration 13.

The induction accelerating system for acceleration 12 is electrically the same as the induction accelerating system for confinement 9 though the role of the induced voltage supplied to the ion beam 3 is different. The differences from the accelerating device for confinement 9 are that the reset voltage generated for preventing magnetic saturation of the magnetic material 10*c* performs no action on the ion beam 3, and the trigger timing of the reset voltage is chosen in a time period when the ion beam 3 does not pass.

The intelligent control device for acceleration 14 includes the pattern generator for acceleration 14*b* that generates the gate signal pattern for acceleration 14*a* for controlling on/off operations of the switching power supply for acceleration 12*b*, and the digital signal processor for acceleration 14*d* that calculates the gate master signal for acceleration 14*c* that controls an operation that is essential information of the generation of the gate signal pattern for acceleration 14*a* by the pattern generator for acceleration 14*b*.

The gate master signal for acceleration 14*c* is calculated by the digital signal processor for acceleration 14*d* according to a previously programmed processing method on the basis of the passage signal 7*b* of the ion beam 3 measured by the bunch monitor 7 that detects the passage of the ion beam 3 placed on the design orbit 4*a*, the position signal 8*a* measured by the position monitor 8 that detects the center of gravity position of the ion beam 3, and the induced voltage signal 12*e* measured by the voltage monitor 12*d* for indicating the value of the induced voltage applied to the ion beam 3, and generated in real time.

Specifically, in the digital signal processor for acceleration 14*d*, trigger timing of the applied induced voltage for acceleration is calculated from the passage signal 7*b* and the position signal 8*a*, and the length of the charging time of the induced voltage for acceleration is calculated from the passage signal 7*a* and the induced voltage signal 12*e*, which are converted into digital signals and sent to the pattern generator for acceleration 14*b*.

The gate signal pattern for acceleration 14*a* includes three patterns of the acceleration voltage 28 applied to the ion beam 3, the reset voltage 29, and the voltage off. The value of the acceleration voltage and the value of the reset voltage are uniquely determined by output voltages of the DC power supply 12*c* and the bank capacitor 23. As a result, the acceleration voltage 28 integrated in time follows an excitation pattern of the electromagnet of the all-ion accelerator 1.

It is demonstrated that the gate signal patterns for confinement and acceleration 11*a* and 14*a* generated in real time can be generated at an arbitrary frequency from substantially 0 Hz to 1 MHz close to an operation limit of semiconductor switching elements of the switching power supplies for confinement and acceleration 9*b* and 12*b* that drive the induction cells for confinement and acceleration 10 and 13. This results from a property of the induction synchrotron that the passage signals 7*a* and 7*b* of the ion beam 3 are obtained from the bunch monitor 7 to generate the gate signal patterns for acceleration 11*a* and 14*a*. Here, the rf cavity 36*a* cannot be used, because the rf frequency may be far from the revolution frequency depending on the ion species, as described earlier, though a radio frequency signal in synchronization with revolution of protons obtained from the rf cavity 36*a* has been used in the previous experiment of induction acceleration of protons that is described in the literature [xx].

Detailed processing of the gate master signals for confinement and acceleration 11*c* and 14*c* in the digital signal processor for confinement and acceleration 11*d* and 14*d* having the feedback function is performed as described below. When an induced voltage higher than an induced voltage that ensures ideal acceleration is actually supplied to the ion beam 3, the ion beam 3 is displaced outward from the design orbit 4*a*. This occurs in a case that there is an error in voltage setting accuracy of the DC power supply 9*c* and 12*c*. In this case, charging voltages of the bank capacitors 23 of the switching power supplies for acceleration 9*b* and 12*b* are shifted from ideal values. Thus, the induced voltages generated in the induction cells for acceleration 10 and 13 are shifted from the value required for acceleration.

Thus, the displacement of the orbit of the ion beam 3 is detected by the position signal 8*a* detected by the position monitor 8 to obtain a momentum shift. The digital signal processor for acceleration 14*d* performs an intelligent calculation so as to stop generation of the acceleration voltage 28 by turn numbers required for correction of the error, and actually stops generation of the gate master signal for acceleration 14*c*. A plural number of position monitors 8 may be used. Using the plural number of position monitors 8 causes the acceleration of the ion beam 3 to be controlled with higher accuracy, and help to avoid loss of the ion beam 3.

The acceleration of the ion beam 3 by the feedback control allows the design orbit 4*a* of the ion beam 3 to be held, and allows all ions to be stably accelerated to any energy level allowed by the bending electromagnet 5 and the focusing electromagnet 6.

Figure 4:
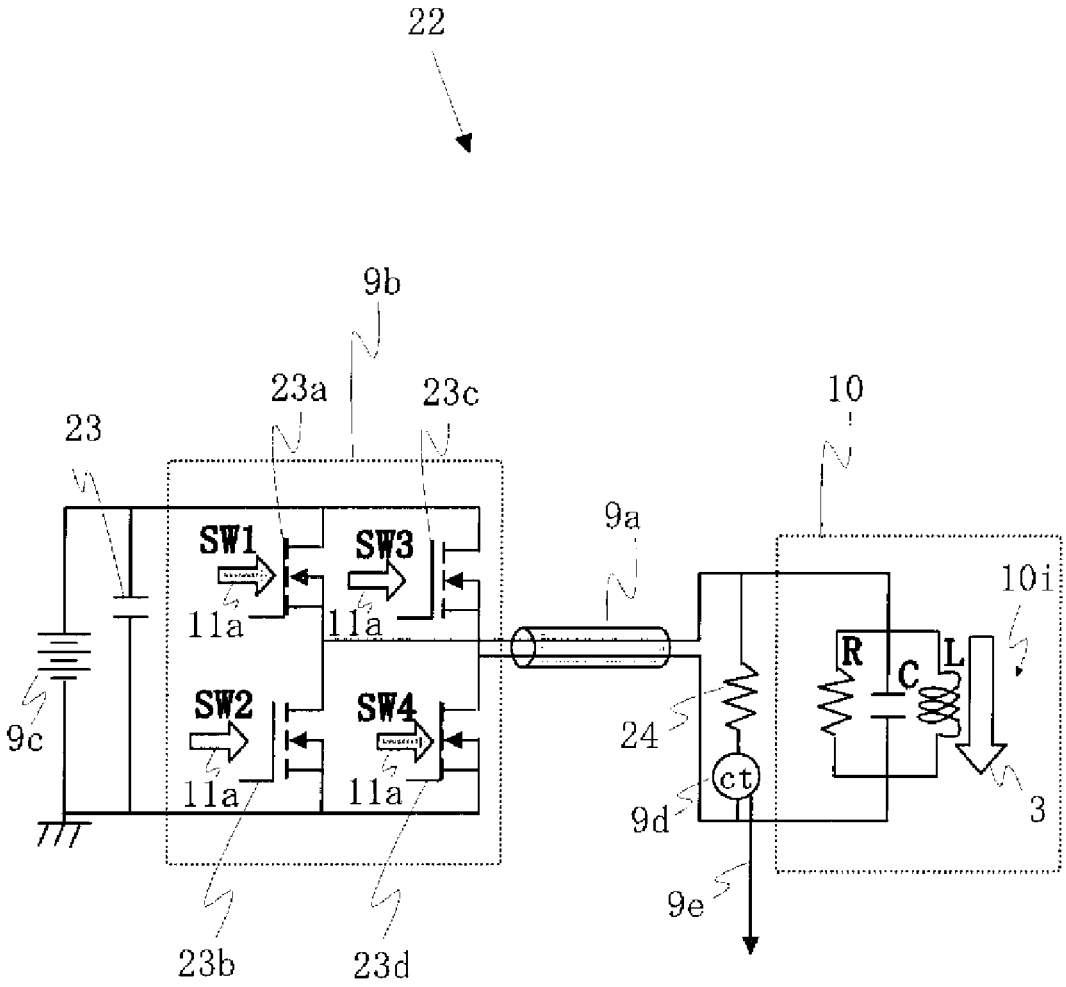
FIG. 4 is an equivalent circuit of an induction accelerating device.

FIG. 4 is an equivalent circuit diagram of the induction accelerating system for confinement. As shown, in the equivalent circuit 22 of the induction accelerating system for confinement, the switching power supply for confinement 9*b* always charged by the DC power supply 9*c* connects to the induction cell for confinement 10 via the transmission line 9*a*. The induction cell for confinement 10 is shown by a parallel circuit consisting of L, C and R. Voltages across the parallel circuit are the induced voltages received by the ion beam 3.

In the circuit in FIG. 4 9*b*, first and fourth switches 23*a* and 23*d* are turned on by the gate signal pattern for confinement 11*a*, the voltage charged in the bank capacitor 23 is applied to the induction cell for confinement 10, and the induced voltage for confinement of the ion beam 3 is generated in the acceleration gap 10*i*. The first and fourth switches 23*a* and 23*d* having been on are then turned off by the gate signal pattern for confinement 11*a*, second and third switches 23*b* and 23*c* are turned on by the gate signal pattern for confinement 11*a*, an induced voltage in an opposite direction is generated in the acceleration gap 10*i*, and excitation of the magnetic material 10*c* is reset. Then, the second and third switches 23*b* and 23*c* are turned off by the gate signal pattern for confinement 11*a*, and the first and fourth switches 23*a* and 23*d* are turned on. Repeating the series of switching operation by the gate signal pattern for confinement 11*a* allows the confinement of the ion beam 3.

The gate signal pattern for confinement 11*a* is a signal for controlling performance of the switching power supply for confinement 9*b*, generated as a digital signal by the intelligent control device for confinement 11 constituted by the digital signal processor for confinement 11*d* and the pattern generator for confinement 11*b* on the basis of the passage signal 7*b* of the ion beam 3, and the induced voltage signal 9*e* for indicating the value of the induced voltage applied to the ion beam 3.

The induced voltage applied to the ion beam 3 is equivalent to the value calculated from the product of a current flowing in the matching resistance 24 and the known magnitude of the matching resistance 24. Thus, the value of the applied induced voltage can be obtained by measuring the current value. Thus, the induced voltage signal 9*e* obtained by the voltage monitor 9*d* that is an ammeter is sent to the digital signal processor for confinement 11*d*, and used for generation of the next gate master signal for confinement 11*c*.

Figure 5:
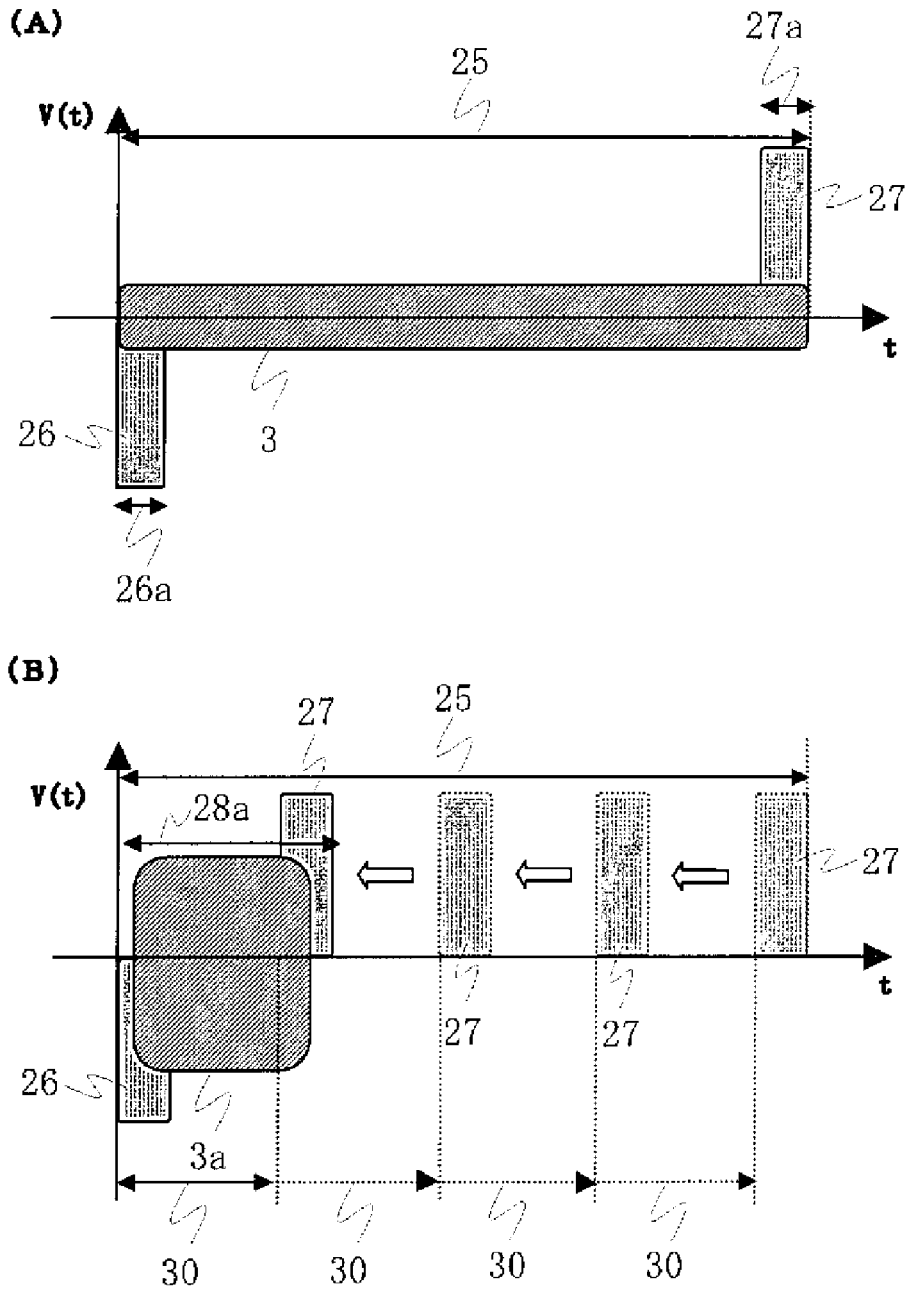
FIG. 5 shows the state of confinement of an ion beam by an induction cell for confinement.

FIG. 5 shows a confinement process of the ion beam by the induction cell for confinement. FIG. 5(A) shows the state of the ion beam 3 just after the start of the confinement. The axis of abscissa represents the time and the axis of ordinate represents the value of the induced voltage. The double-headed arrow shows a revolution time period 25 for one turn of the ion beam 3 along the design orbit 4*a*. The same applies to FIG. 5(B).

In order to trap a left tip of the ion beam 3 extending along the entire design orbit 4*a*, each switch of the switching power supply for confinement 9*b* is turned on so that the negative barrier voltage 26, that is the induced voltage in the direction opposite the propagating direction of ions, is generated in the induction cell for confinement 10. The charging time 26*a* of the negative barrier voltage 26 to the ion beam 3 may be short. Then, each switch of the switching power supply for confinement 9*b* is turned on to trap the other end of the ion beam 3 so that the positive barrier voltage 27 in the same direction as the propagating direction of the ion beam 3 is generated in the induction cell for confinement 10 near the end of the revolution time period 25 of the ion beam 3 that corresponds the end of the ion beam 3. The positive barrier voltage 27 is simultaneously used for avoiding the magnetic saturation of the magnetic material 10*c*; therefore, the amplitude and pulse width of the negative and positive barrier voltages 26 needs to be same. These barrier voltages causes the confinement of the entire ion beam 3 injected into the induction synchrotron 2 and distributed along the entire design orbit 4*a*.

The length of the bunch 3*a* largely shrinks in time if a non-relativistic region, associated with acceleration, because of the rapid change in velocity of the bunch. FIG. 5(B) shows a process how the barrier voltages follows this shrinking.

A time duration between generations of the negative barrier voltage 26, that traps the tip of the ion beam 3, and the positive barrier voltage 27, that traps the end of the ion beam 3 (hereinafter referred to as a time duration between barrier voltage pulses 30), is reduced, and the ion beam 3 is formed into the bunch 3*a* having the length within the charging time 28*a* of the acceleration voltage 28 so that the ion beam 3 can be accelerated in the charging time 28*a* of the acceleration voltage 28 generated in the different induction cell for acceleration 13.

Specifically, the trigger timing of the negative barrier voltage 26 is fixed, and the control to advance the trigger timing of the positive barrier voltage 27 is performed by the intelligent control device for confinement 11. The outline left arrows show a moving direction of the trigger timing of the positive barrier voltage 27.

Figure 6:
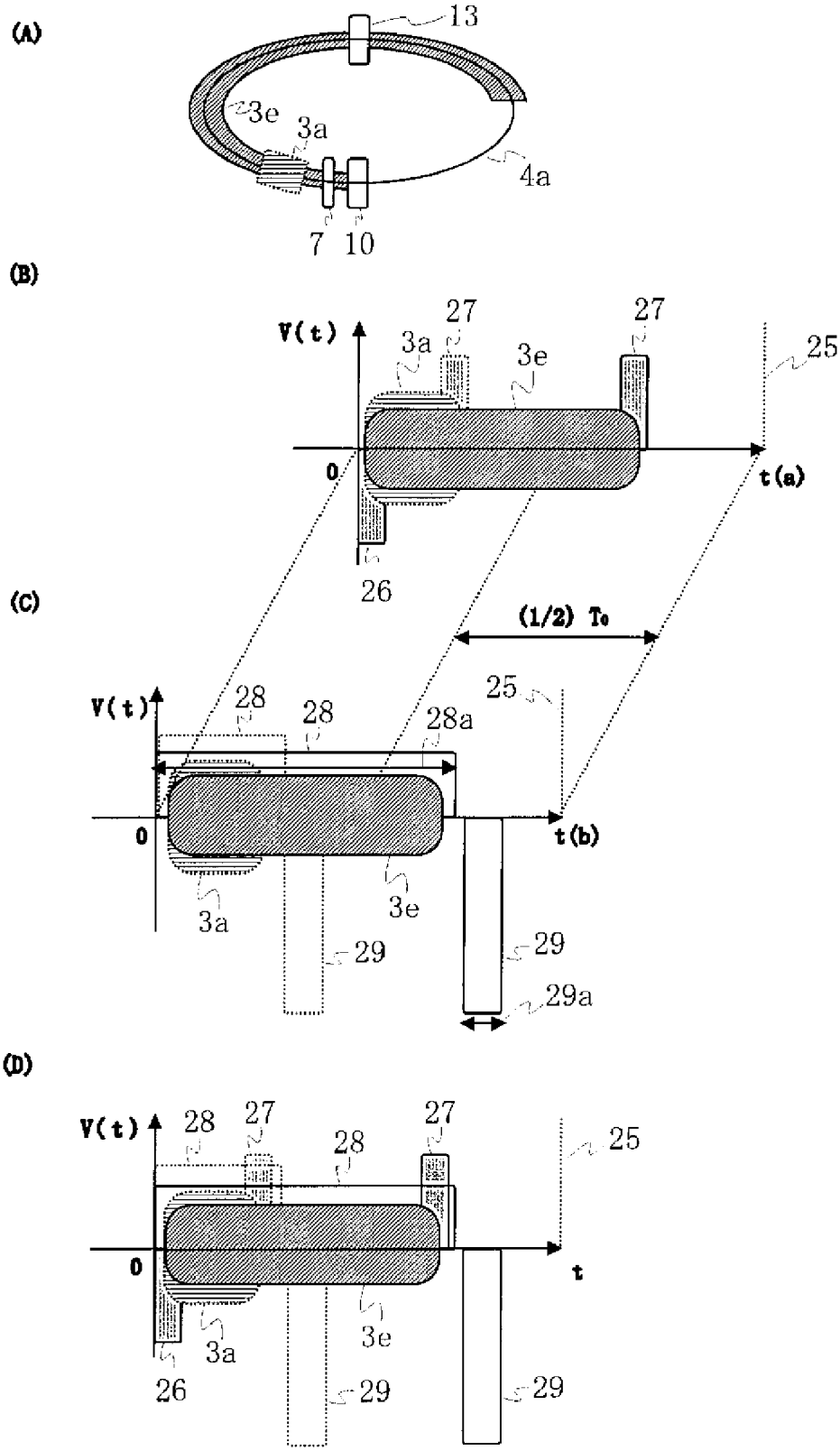
FIG. 6 shows the state of acceleration of the ion beam by the induction cell.

FIG. 6 shows the state of acceleration of the ion beam by the induction synchrotron of the present invention. V(t) denotes the induced voltage value.

FIG. 6(A) shows positions of the bunch 3*a* or the super-bunch 3*e* of the ion beam 3 (both bunches may not exist in the same acceleration period) on the design orbit 4*a* at a certain time during acceleration. With reference to FIG. 6, for the simplicity, a case where confinement and acceleration of the ion beam 3 is performed in one induction cell for confinement 10 and one induction cell for acceleration 13 facing the design orbit 4*a* will be described, although multiple induction sells are employed in a real situation. The passage of the ion beam 3 is confirmed by the passage signals 7*a* and 7*b* of the bunch monitor 7.

FIG. 6(B) shows the state of confinement of the ion beam 3 by the induction cell for confinement 10. t(a) denotes the trigger timing of the barrier voltage and the charging times 26*a* and 27*a* with reference to time when the bunch 3*a* or the super-bunch 3*e* reaches the induction cell for confinement 10. The dotted vertical line shows the revolution time period 25 of the bunch 3*a* or the super-bunch 3*e*. The same applies to FIG. 6(C) (D).

The time, when the bunch 3*a* or the super-bunch 3*e* reaches the induction cell for confinement 10 in the succeeding turn, is calculated by the digital signal processor for confinement 11*d* on the basis of the passage signal 7*a* obtained from the bunch monitor 7, and then the gate signal pattern for confinement 11*a* is generated so as to generate the negative barrier voltage 26, and the negative barrier voltage 26 is applied to the bunch head 3 or the head of the super-bunch 3*e*.

The time, when the tail of the bunch 3*a* or the super bunch 3*e* reaches the induction cell for confinement 10 in the succeeding turn, is calculated by the digital signal processor for confinement 11*d* on the basis of the passage signal 7*a* obtained from the bunch monitor 7, the gate signal pattern for confinement 11*a* is generated so as to generate the positive barrier voltage 27, and the positive barrier voltage 27 is applied to the bunch tail 3*d* or the tail of the super-bunch 3*e*.

In this manner, the bunch 3*a* or the super-bunch 3*e* can be confined. The trigger timing of the applied negative and positive barrier voltages 26 and 27 are calculated by the digital signal processor for confinement 11*d* on the basis of the induced voltage signal 9*e* from the voltage monitor 9*d*, and used by the next gate master signal for confinement 11*c*. A short bunch 3*a* of the ion beam 3 can be accommodated simply by reducing the time duration between barrier voltage pulses 30.

FIG. 6(C) shows the state of acceleration of the ion beam 3 by the induction cell for acceleration 13. t(b) denotes the trigger timing of the induced voltage for acceleration and the charging times 28*a* and 29*a* with reference to time when the bunch 3*a* or the super-bunch 3*e* reach the induction cell for acceleration 13.

The time, when the bunch 3*a* or the super-bunch 3*e* reaches the induction cell for acceleration 13, is calculated by the digital signal processor for acceleration 14*d* on the basis of the passage signal 7*a* obtained from the bunch monitor 7, and then the gate signal pattern for acceleration 14*a* is generated and the acceleration voltage 28 is applied to the entire bunch 3*a* or super bunch 3*e*.

The induced voltage having an opposite polarity from the acceleration voltage 28 as a reset voltage is applied on the induction cell for acceleration for avoiding magnetic saturation of the magnetic material 10*c* in a time period calculated by the digital signal processor for acceleration 14*d*, in which the ion beam 3 does not exist. In this manner, the bunch 3*a* or the super-bunch 3*e* can be accelerated. $(1/2)T_0$ means that the time references of t(a) in FIG. 6(B) and t(b) in FIG. 6(C) are shifted by half of the revolution time period 25.

FIG. 6(D) shows the state of acceleration of the bunch 3*a* or the super-bunch 3*e* at a certain time, which is a composition of FIG. 6(B) and FIG. 6(C). Thus, t on the axis of abscissa represents the time reference shifted from the time references of the induction cell for confinement 10 and the induction cell for acceleration 13 by half of the revolution time period 25. The same applies to t in FIG. 7.

Figure 7:
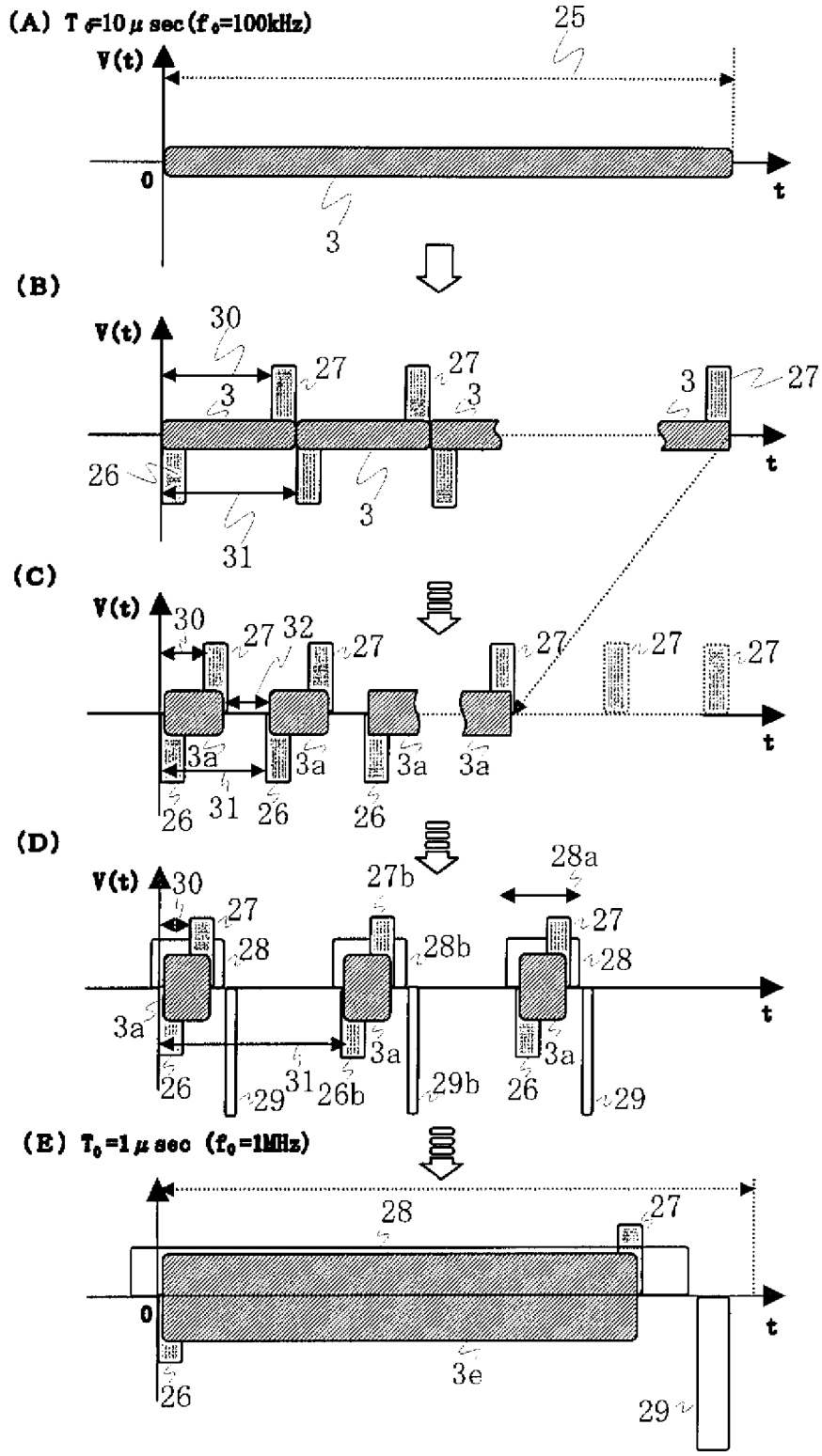
FIG. 7 shows the state of intermittent confinement and acceleration of the ion beam by the induction cell.

FIG. 7 shows a method for accelerating the ion beam 3 after being formed into multiple bunches 3*a*. This method has an advantage of reducing the induced voltage value of the barrier voltage.

The method for accelerating the ion beam 3 after being formed into the multiple bunches 3*a* can be performed by first dividing the injected ion beam 3 in the form of the DC beam into the multiple bunches 3*a*, finally forming the multiple bunches 3*a* into a single bunch 3*a* (super-bunch 3*e*), and following the order from FIGS. 7(A) to (E).

The axis of ordinate represents the induced voltage value and the axis of abscissa represents time. The double-headed lateral broken arrow shows the revolution time period 25 of ions just after the injection.

FIG. 7(A) shows the state just after the ion beam 3 accelerated up to a certain energy level by the preinjector 17 is injected into the vacuum duct 4 in a way of multi-turn. The injected ion beam 3 is placed in the form of the DC beam along the entire design orbit 4*a*. The description will be made on a uranium ion (+39) as an example with the revolution time period 25 at this time of 10 μs and the revolution frequency in injection on the order of 100 kHz.

FIG. 7(B) shows a method for confinement of the ion beam 3 placed on the entire design orbit 4*a* in the form of multiple ion bunches 3 by the barrier voltage applied by the induction cell for confinement 10. The double-headed lateral solid arrow denotes a time duration between barrier voltage pulses 30. The double-headed lateral solid arrow denotes a time period between the trigger timings of adjacent barrier voltages having the same polarity (hereinafter referred to as a time duration between the same polarity barrier voltage pulses 31).

In this manner, the ion beam 3 placed along the entire design orbit 4*a* is separated into the multiple ion segments 3. When the charging times 26*a* and 27*a* of the barrier voltage by the induction cell for confinement 10 are each 0.5 μs or less, the ion beam 3 can be separated into ten sections of ion beam 3.

FIG. 7(C) shows a method for forming the segmented ion beams 3 into the multiple bunches 3*a*. The pulse duration between barrier voltage pulses 30 is gradually reduced, and the time duration between the same polarity barrier voltage pulses 31 is also reduced. Then, the multiple bunches are ready to receive the acceleration voltage 28, as seen in FIG. 7(D). Associated with acceleration, the time duration between the positive barrier voltage 27 and the negative barrier voltage 26 generated next is reduced so as to reduce an interval between adjacent bunches 3*a* (hereinafter referred to as a bunch interval 32) to bring the confined bunches 3*a* close to each other.

FIG. 7(D) shows a process to combine the multiple bunches 3*a* into a single bunch 3*a*. A combined single bunch 3*a* is created by applying only the first negative barrier voltage 26 and the last positive barrier voltage 27 among the negative and positive barrier voltages 26*b* and 27*b* capturing the multiple bunches 3*a*. The negative and positive barrier voltages 26*b* and 27*b* that are not applied can be selected by generating the gate signal pattern for confinement 11*a* in real time according to a processing method previously programmed in the digital signal processor for confinement 11*d* of the intelligent control device for confinement 11 depending on ion species and predetermined energy level. The selection of an acceleration voltage 28*b* and a reset voltage 29*b* that are unnecessary, and the stop of their generation is controlled by the intelligent control device for acceleration 14.

Further, if the bunches 3*a* can be confined or connected within the range of the charging time 28*a* of the acceleration voltage 28 by the induction cell for acceleration 13 before the ion beam 3 is formed into the single bunch 3*a*, the generation of the acceleration voltage 28 and the reset voltage 29 is controlled by the intelligent control device for acceleration 14 to allow the ion beam 3 to be more efficiently accelerated up to a set energy level.

FIG. 7(E) shows the state where the ion beam 3 is completely formed into the single bunch 3*a* (super-bunch) and confined and accelerated. With the processes shown in FIGS. 7(A) to (E), the ion beam 3 can be accelerated up to the set energy level more efficiently than the confinement and acceleration methods shown in FIGS. 5 and 6. The method described here can be adopted because the driving frequency of the switching power supplies for confinement and acceleration 9*b* and 12*b* is variable from 0 Hz to 1 MHz, and the gate signal patterns for confinement and acceleration 11*a* and 14*a* can be generated in real time by the digital signal processors for confinement and acceleration 11*d* and 14*d* and the pattern generators for confinement and acceleration 11*b* and 14*b*.

Figure 8:
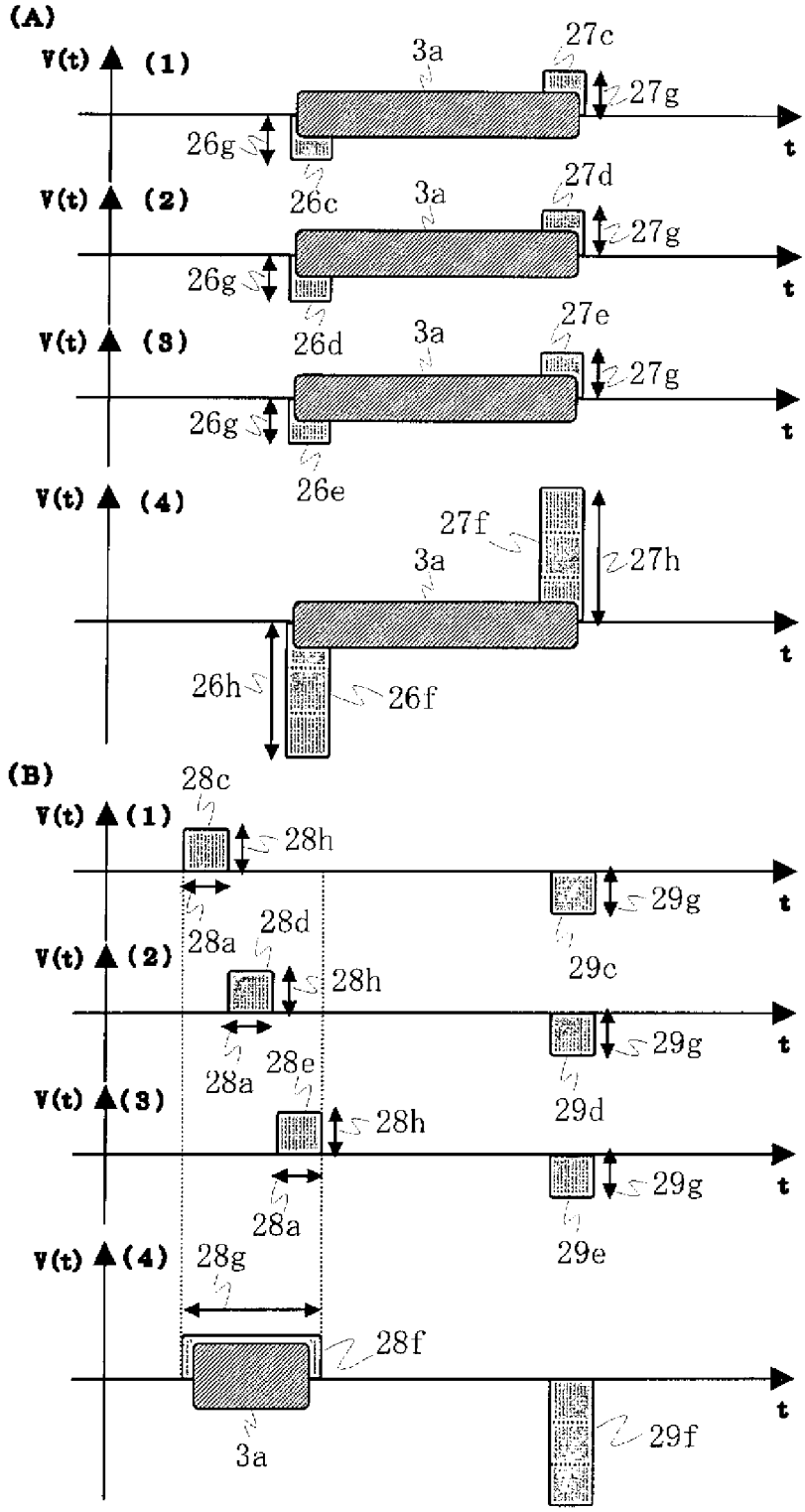
FIG. 8 shows confinement and acceleration control by triple induction cells.

FIG. 8 shows an acceleration method of the ion beam by multiple induction cells. Generally, it is required that the barrier voltage is relatively high in the short charging times 26*a* and 27*a*, the acceleration voltage 28 is relatively low in the long charging time 28*a*, and the reset voltage 29 has to have the same value of the product of charging time 29*a* and voltage as that of the acceleration voltage pulse. The requirement can be satisfied by using the multiple induction cells for confinement and acceleration 10 and 13. As an example, an operation pattern in use of triple induction cells for confinement and acceleration 10 and 13 will be described. This method can increase the flexibility of the selection of ions and energy levels.

FIG. 8(A) shows the size of the barrier voltage supplied by the triple induction cells for confinement 10 and the charging time. The axis of ordinate represents voltage and the axis of abscissa represents time. (1), (2) and (3) denote the first induction cell for confinement 10, the second induction cell for confinement 10, and the third induction cell for confinement 10. (4) denotes the substantially superimposed negative and positive barrier voltages 26*f* and 27*f* that are applied to the ion beam 3 by the triple induction cells for confinement 10.

Negative barrier voltages 26*c*, 26*d* and 26*e* are applied to the bunch 3*a* of the ion beam 3 that has reached the triple induction cells for confinement 10 in the order from (1) to (3). Since the bunch 3*a* circulates along the design orbit with a large velocity, change in the relative position of an individual ion within the time-difference of arrival is quite small and neglected. It is understood that the negative barrier voltages 26*c*, 26*d* and 26*e* are applied to the bunch 3*a* substantially at the same time. Similarly, positive barrier voltages 27*c*, 27*d* and 27*e* are applied to the bunch tail 3*d*. Thus, the barrier voltage equal to the total negative and positive barrier voltages 26*f* and 27*f* in (4) are applied to the bunch 3*a* at the bunch head 3*c* and the bunch tail 3*d*. In this manner, the induction cells for confinement 10 are combined to effectively obtain required barrier voltages. Specifically, even if the values of barrier voltage 26*g* and 27*g* applied by a single induction cell for confinement 10 is low, a high barrier voltage values 26*h* and 27*h* can be obtained.

FIG. 8(B) shows how an effectively long acceleration voltage is obtained by combining the triple induction cells for acceleration 13 and the charging time. The axis of ordinate represents induced voltage for acceleration, and the axis of abscissa represents time. In addition, three pairs of acceleration voltage pulse 28*a* and its reset pulse 29*c* are shown. (1), (2) and (3) denote a first induction cell for acceleration 13, a second induction cell for acceleration 13, and a third induction cell for acceleration 13. Three acceleration voltage pulses are generated with a systematic delay in time, as seen in FIG. 8(B). (4) denotes the total acceleration voltage 28*f* and the total reset voltage 29*f* applied to the bunch 3*a* by the triple induction cells for acceleration 13. It is noted that the reset voltage pulses are simultaneously generated.

Acceleration voltages 28*c*, 28*d* and 28*e* at a certain acceleration voltage value 28*h* are first applied to the ion beam 3 having reached the triple induction cells for acceleration 13 in the order from (1) to (3). At this time, the charging time is shifted from (1) to (3), and thus the acceleration voltages 28*c*, 28*d* and 28*e* can be applied to the entire ion beam 3. This ensures the charging time 28*g* of the total acceleration voltage 28*f* in (4) for the entire ion beam 3. Even if one induction cell for acceleration 13 can apply the acceleration voltage 28 only in a short charging time 28*a*, the induction cells for acceleration 13 are combined to ensure a long charging time 28*a*. Specifically, the two objects of confinement and acceleration can be accommodated only by the combination of the unit induction cells that can generate a low induced voltage. This can reduce production costs of the induction accelerating system.

Reset voltages 29*c*, 29*d* are 29*e* are applied for avoiding magnetic saturation of the triple induction cells for acceleration 13 in a time period without the ion beam 3. In theory, the time period other than the time period for the application of the reset voltages 29*c*, 29*d* and 29*e* can be used as the time period for application of the acceleration voltage 28, thereby allowing all ions to be accelerated as the super-bunch 3*e*.

Since the gate signal pattern for confinement 11*a* of the switching element in the switching power supply for confinement 9*b* is freely controlled, the arbitrary time duration of the barriers voltage pulses can be achieved. As a result, the bunch 3*a* can be held in a long shape in the propagating direction of ions with a uniform distribution of ions, which cannot be achieved in principle by the conventional rf synchrotron 35, thereby significantly increasing the number of ions that can be simultaneously accelerated.

Figure 9:
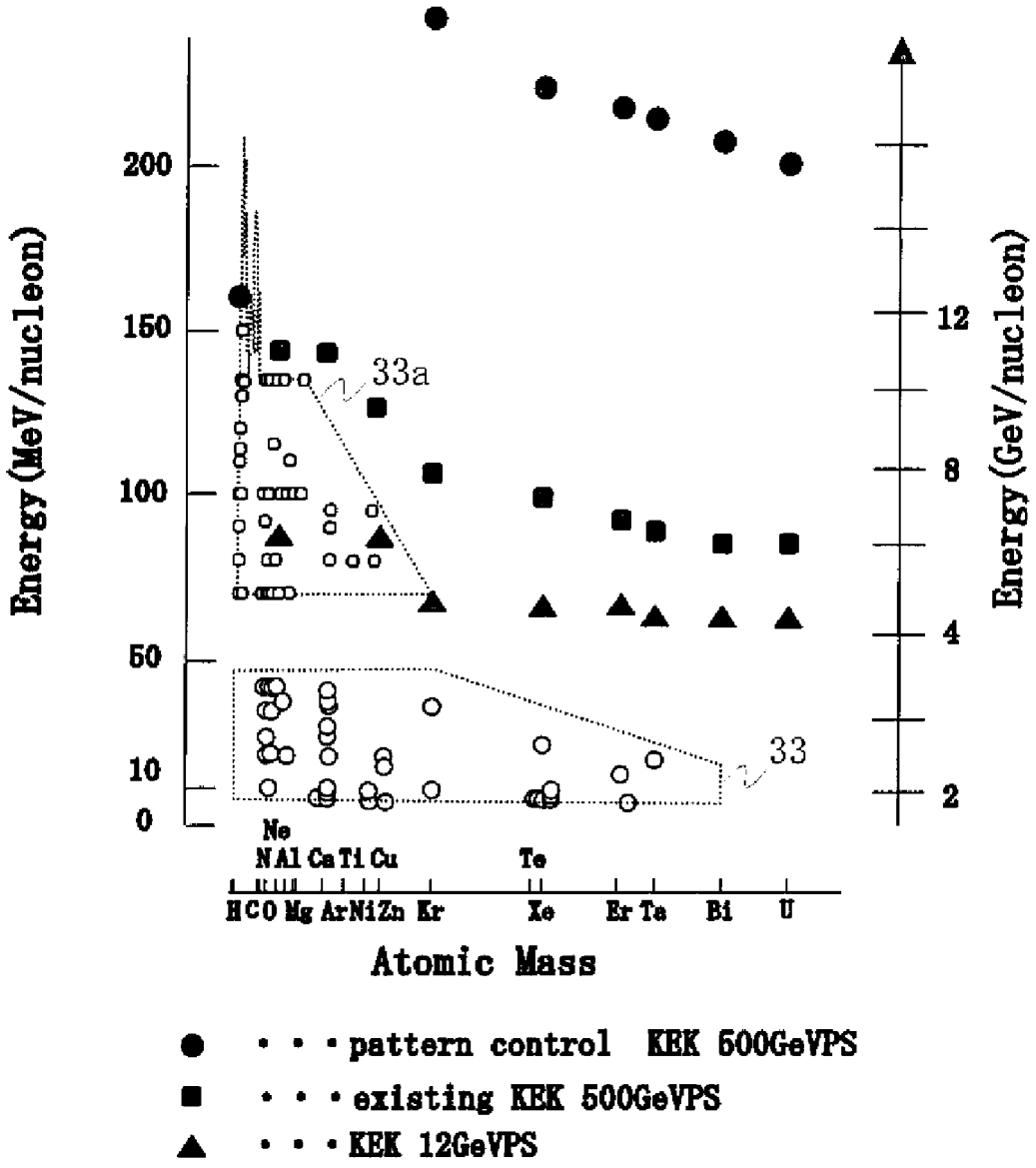
FIG. 9 shows an attainable energy level in acceleration of various ions.
Figure 10:
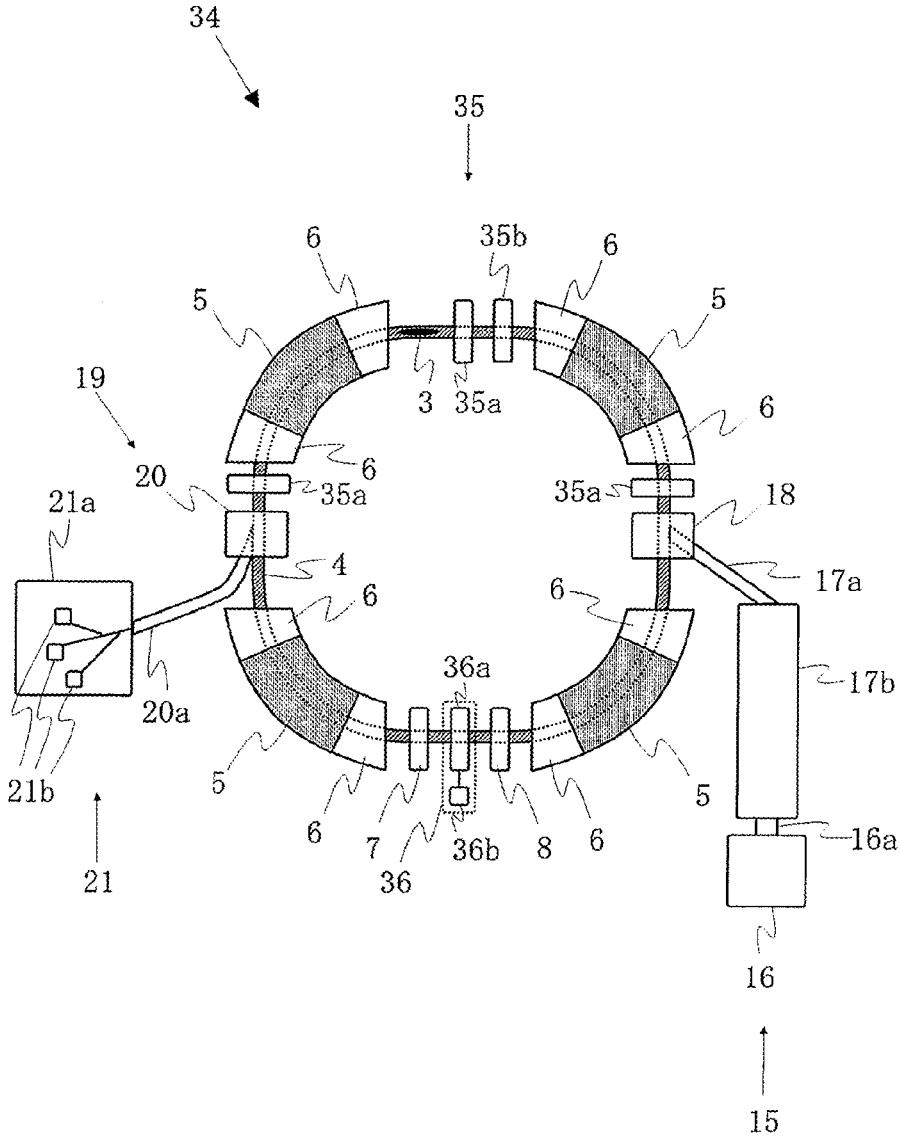
Fig. 10 PRIOR ART
FIG. 10 is a whole block diagram of a conventional rf synchrotron complex.

FIG. 9 shows the results of calculation of attainable energy per nucleon for various ions having their maximum charge state that can be attained when the existing KEK 500 MeVPS and 12 GeVPS are switched to the all-ion accelerator of the present invention.

As the ion beam 3, the following species are chosen: H (hydrogen), C (carbon), N (nitrogen), Ne (neon), Al (aluminum), Ca (calcium), O (oxygen), Mg (magnesium), Ar (argon), Ni (nickel), Zn (zinc), Kr (krypton), Xe (xenon), Er (erbium), Ta (tantalum), Bi (bismuth), U (uranium), Te (tellurium), Cu (copper), and Ti (titanium).

The axis of abscissa in the graph represents the atomic number, and atoms are plotted in increasing order of the atomic number from the left. The axis of ordinate in the graph represents the amount of energy per nucleon of ions accelerated by each accelerator. The unit of the left axis is megavolt (MeV), and the unit of the right axis is gigavolt (GeV). The right axis is used only for reference to the results of the changed 12 GeVPS.

■ shows a prediction of attainable energy of various ion beams 3 when the existing KEK 500 MeVPS (an electromagnet power supply that is an existing resonant power supply is used as it is) is switched to the all-ion accelerator 1 of the present invention, ● shows a prediction thereof when the switched KEK 500 MeVPS (the electromagnet power supply that is the existing resonant power supply is replaced by a pattern power supply), and ▲ shows a prediction result thereof when the KEK 12 GeVPS is switched to the all-ion accelerator 1 of the present invention.

For a comparison with the conventional accelerator, there is also shown the actual performance of acceleration (within the broken line) of the ion beam 3 in a ring cyclotron being operated in The Institute of Physical and Chemical Research that so far had been the largest-sized cyclotron in Japan and has a similar physical size to the KEK 500 MeV PS. O surrounded by one broken line shows the obtained energy for various ion species in a case of the linear rf accelerator injection 33 into the cyclotron. □ surrounded by the other broken line shows the obtained energy for various ion species in a case using the AVF cyclotron as an injector.

In a slow cycle synchrotron using an electromagnet driven by a pattern control power supply, its extraction energy is easily changed. In a rapid cycle synchrotron using an electromagnet driven by a resonant circuit power supply, the acceleration energy per nucleon is determined by the mass number and charge state of the ion of concern, because of a constant field strength.

The result shown in FIG. 9 suggests that all-ion accelerator 1 of the present invention achieves the followings.

First, the 500 MeVPS (■ and ●) covers an energy area that is unattainable by the conventional cyclotron. Specifically, even in the rf linear accelerator injection 33 (○) that can accelerate particular heavy ions, ion species that can be accelerated are limited by an limited acceleration distance of the rf linear accelerator 17*b* and a physical limit of the rf employed in the cyclotron, and the attainable energy level is also limited by the physical limit of electromagnet. The ions that can be accelerated include a proton to Ta, and the attainable energy thereof is 7 to 50 MeV per nucleon.

On the other hand, in the AVF cyclotron injection 33*a* (□), the ion can be accelerated up to a certain high energy level (about 200 MeV) if the ion is light such as a proton, compared with the case of the rf linear accelerator injection 33 (○), though the ions that can be accelerated are up to Cu, Zn by a limit of the injector.

Second, in the modified 12 GeVPS, even heavy ions can be accelerated to energy of about 4 GeV or more per nucleon.

Thus, the all-ion accelerator 1 of the present invention is used to accelerate all ions including heavy ions up to any energy level allowed by the magnetic field strength, some of which cannot be achieved by the conventional cyclotron and rf synchrotron 35.

INDUSTRIAL APPLICABILITY

The present invention has the above described configuration and can obtain the following advantages. First, the conventional rf synchrotron 35 can be switched to the all-ion accelerator 1 of the present invention as every devices of the conventional rf synchrotron 35 other than the radio frequency accelerating device 36 are available in the all-ion accelerator.

Second, the all-ion accelerator 1 of the present invention can accelerate all ions by itself up to any energy level allowed by the magnetic fields for beam guiding.

Specifically, the 12 GeVPS has been demonstrated as an all-ion accelerator and the KEK 500 MeVPS is going to be modified to the all-ion accelerator 1 of the present invention, thus for the 500 MeVPS, various ions can be accelerated to the energy level unattainable even by the cyclotron of The Institute of Physical and Chemical Research normally operated for material and life science, and for the 12 GeVPS, all ions can be accelerated up to about 4 GeV per nucleon to the maximum.

Further, the all-ion accelerator of the present invention takes the above described advantages, and thus can supply heavier ions in any charge state besides carbon beams that have been recently supplied for cancer therapy, which may significantly increase type of cancers that can be treated by particle beams and remarkably increase the flexibility of therapy. Also, the flexibility in production of medical radio isotopes, radio activation analysis by short-lived nucleus, and semiconductor damage tests is significantly increased. Further, the ground check for predicting damages by heavy ion cosmic rays can be performed of various kinds of electronic equipment mounted in satellites used in aerospace.

The invention claimed is:

1. An all-ion accelerator including an annular vacuum duct having a design orbit of an ion beam therein, a bunch monitor that is provided in said vacuum duct and detects passage of the ion beam and generates a passage signal, a position monitor that is provided in said vacuum duct and detects the center of gravity position of the ion beam and generates a position signal, the all-ion accelerator comprising:

an intelligent control device for confinement controlling on/off of an induction cell for confinement, and performing feedback control of trigger timing and a charging time of an induced voltage applied to the ion beam by the induction cell for confinement, wherein the intelligent control device for confinement comprises a digital signal processor for confinement and a pattern generator for confinement generating a gate signal pattern for confinement on the basis of the passage signal of the ion beam and an induced voltage signal indicating the value of the induced voltage applied to the ion beam, an intelligent control device for acceleration controlling on/off of an induction cell for acceleration, and performs feedback control of trigger timing and a charging time of an induced voltage applied to the ion beam by the induction cell for acceleration, wherein the intelligent control device for acceleration comprises a digital signal processor for acceleration and a pattern generator for acceleration generating a gate signal pattern for acceleration on the basis of the passage signal, the position signal of the ion beam and an induced voltage signal indicating the value of the induced voltage applied to the ion beam, wherein the induced voltage applied by the induction cell for confinement and the induced voltage applied by the induction cell for acceleration are generated in synchronization with revolution of all ions for acceleration.

2. An all-ion accelerator comprising:

an induction synchrotron including an annular vacuum duct having a design orbit of an ion beam therein, a bending electromagnet that is provided on a curved portion of said design orbit and holds a circular orbit of the ion beam, a focusing electromagnet that is provided on a linear portion of said design orbit and prevents diffusion of the ion beam, a bunch monitor that is provided in said vacuum duct and detects passage of the ion beam, a position monitor that is provided in said vacuum duct and detects the center of gravity position of the ion beam, an induction accelerating device for confinement including an induction cell for confinement that is connected to said vacuum duct and applies an induced voltage for confinement of the ion beam in a propagating direction of ions and an intelligent control device for confinement that controls driving of said induction cell for confinement, and an induction accelerating device for acceleration including an induction cell for acceleration that is connected to said vacuum duct and applies an induced voltage for acceleration of the ion beam and an intelligent control device for acceleration that controls driving of said induction cell for acceleration;

an injection device or a high voltage ion source including an injector that injects the ion beam into said induction synchrotron, with ions generated by an ion source being accelerated up to a certain energy level by a preinjector; and an extraction device that extracts the ion beam from said induction synchrotron to an ion beam utility line, wherein said intelligent control device for confinement performs feedback control of trigger timing and a charging time of the induced voltage applied by said induction cell for confinement with a digital signal processor for confinement that receives a passage signal from said bunch monitor and an induced voltage signal from a voltage monitor for indicating the value of the induced voltage applied to the ion beam by the induction cell for confinement, and calculates a gate master signal for confinement that forms the basis of a gate signal pattern for confinement of a pattern generator for confinement, the pattern generator for confinement generating a gate signal pattern for confinement that controls on/off of a switching power supply for confinement for driving said induction cell for confinement, and said intelligent control device for acceleration performs feedback control of trigger timing and a charging time of an induced voltage applied to said induction cell for acceleration with a digital signal processor for acceleration that receives a passage signal from said bunch monitor, a position signal from said position monitor, and an induced voltage signal from the voltage monitor for indicating the value of the induced voltage applied to the ion beam by the induction cell for acceleration, and calculates a gate master signal for acceleration that forms the basis of a gate signal pattern for acceleration of a pattern generator for acceleration, the pattern generator for acceleration generating a gate signal pattern for acceleration that controls on/off of a switching power supply for acceleration for driving said induction cell for acceleration, wherein the induced voltage applied by the induction cell for confinement and the induced voltage applied by the induction cell for acceleration are generated in synchronization with revolution of all ions for acceleration.

3. An ion beam accelerating method comprising the steps of:

in a circular accelerator into which an induction cell for acceleration and an induction cell for confinement are incorporated, wherein the circular accelerator comprises an annular vacuum duct having a design orbit of an ion beam therein, a bunch monitor that is provided in said vacuum duct and detects passage of the ion beam and generates a passage signal, a position monitor that is provided in said vacuum duct and detects the center of gravity position of the ion beam and generates a position signal, performing feedback control of trigger timing and a charging time of an induced voltage applied from the induction cell for confinement to the ion beam on the basis of the passage signal of the ion beam and an induced voltage signal indicating the value of the induced voltage applied to the ion beam, and performing feedback control of trigger timing and a charging time of an induced voltage applied from the induction cell for acceleration to the ion beam on the basis of the passage signal of the ion beam, the position signal, and the induced voltage signal indicating the value of the induced voltage applied to the ion beam, wherein the induced voltage applied by the induction cell for confinement and the induced voltage applied by the induction cell for acceleration are generated in synchronization with revolution of all ions for acceleration.

* * * * *